US011158496B2

(12) United States Patent
Ramsey et al.

(10) Patent No.: US 11,158,496 B2
(45) Date of Patent: Oct. 26, 2021

(54) MINIATURE CHARGED PARTICLE TRAP WITH ELONGATED TRAPPING REGION FOR MASS SPECTROMETRY

(71) Applicant: The University of North Carolina at Chapel Hill, Chapel Hill, NC (US)

(72) Inventors: J. Michael Ramsey, Chapel Hill, NC (US); Kevin Schultze, Chapel Hill, NC (US)

(73) Assignee: The University of North Carolina at Chapel Hill, Chapel Hill, NC (US)

( * ) Notice: Subject to any disclaimer, the term of this patent is extended or adjusted under 35 U.S.C. 154(b) by 0 days.

(21) Appl. No.: 16/199,816

(22) Filed: Nov. 26, 2018

(65) Prior Publication Data

US 2019/0096655 A1 Mar. 28, 2019

Related U.S. Application Data

(63) Continuation of application No. 15/600,325, filed on May 19, 2017, now Pat. No. 10,141,178, which is a (Continued)

(51) Int. Cl.
*H01J 49/42* (2006.01)
*H01J 49/02* (2006.01)
(Continued)

(52) U.S. Cl.
CPC ..... *H01J 49/4245* (2013.01); *H01J 49/0013* (2013.01); *H01J 49/0031* (2013.01); (Continued)

(58) Field of Classification Search
CPC ..... H01J 49/4245; H01J 49/0013; H01J 49/0031; H01J 49/02; H01J 49/06; (Continued)

(56) References Cited

U.S. PATENT DOCUMENTS 2,939,952 A 6/1960 Paul et al.
5,051,582 A 9/1991 Bahns et al.
(Continued)

FOREIGN PATENT DOCUMENTS

WO WO 2007/089339 8/2007
WO WO 2011/086430 7/2011

OTHER PUBLICATIONS

Alberici et al., Ambient mass spectrometry: bringing MS into the 'real world,' Anal. Bioanal. Chem. 398(1): 265-294 (2010).
(Continued)

*Primary Examiner* — Sean M Luck
(74) *Attorney, Agent, or Firm* — Myers Bigel, P.A.

(57) ABSTRACT

A miniature electrode apparatus is disclosed for trapping charged particles, the apparatus including, along a longitudinal direction: a first end cap electrode; a central electrode having an aperture; and a second end cap electrode. The aperture is elongated in the lateral plane and extends through the central electrode along the longitudinal direction and the central electrode surrounds the aperture in a lateral plane perpendicular to the longitudinal direction to define a transverse cavity for trapping charged particles.

31 Claims, 29 Drawing Sheets

Related U.S. Application Data continuation of application No. 14/980,268, filed on Dec. 28, 2015, now abandoned, which is a continuation of application No. 14/456,686, filed on Aug. 11, 2014, now Pat. No. 9,252,005, which is a continuation of application No. 13/840,653, filed on Mar. 15, 2013, now Pat. No. 8,878,127.

(51) Int. Cl.
*H01J 49/06* (2006.01)
*H01J 49/00* (2006.01)

(52) U.S. Cl.
CPC ..... *H01J 49/02* (2013.01); *H01J 49/06* (2013.01); *H01J 49/424* (2013.01); *H01J 49/4235* (2013.01); *H01J 49/4255* (2013.01); *H01J 49/062* (2013.01)

(58) Field of Classification Search
CPC .. H01J 49/4235; H01J 49/424; H01J 49/4255; H01J 49/062
See application file for complete search history.

(56) References Cited

U.S. PATENT DOCUMENTS 5,118,950 A 6/1992 Bahns et al.
5,206,506 A 4/1993 Kirchner
5,248,883 A 9/1993 Brewer et al.
5,596,193 A 1/1997 Chutjian et al.
5,613,294 A 3/1997 Ferran
5,793,091 A 8/1998 Devoe
5,811,820 A 9/1998 Kirchner et al.
5,859,433 A 1/1999 Franzen
5,866,901 A 2/1999 Penn et al.
6,157,031 A 12/2000 Prestage
6,452,326 B1 9/2002 Ge et al.
6,469,298 B1 10/2002 Ramsey et al.
6,483,109 B1 11/2002 Reinhold et al.
6,521,898 B2 2/2003 ChutJian et al.
6,545,268 B1 4/2003 Verentchikov et al.
6,762,406 B2 7/2004 Cooks et al.
6,822,225 B2 11/2004 Xu et al.
6,838,666 B2 1/2005 Ouyang et al.
6,870,158 B1 3/2005 Blain
6,933,498 B1 8/2005 Whitten et al.
7,217,922 B2 5/2007 Jachowski et al.
7,560,688 B2 7/2009 Clowers et al.
7,772,546 B2 8/2010 Jackson
7,847,240 B2 * 12/2010 Reinhold ..... H01J 49/427 250/281
7,973,277 B2 7/2011 Rafferty
8,101,908 B2 1/2012 Senko
8,878,127 B2 11/2014 Ramsey et al.
9,373,492 B2 * 6/2016 Ramsey ..... H01J 49/0022
9,406,492 B1 * 8/2016 Ramsey ..... H01J 49/165
2002/0195559 A1 12/2002 Miseki
2003/0089846 A1 * 5/2003 Cooks ..... H01J 49/0013 250/281
2004/0135080 A1 7/2004 Ouyang et al.
2005/0061767 A1 3/2005 Pai et al.
2005/0061966 A1 3/2005 Ding et al.
2005/0196720 A1 9/2005 Ostler et al.
2006/0219888 A1 10/2006 Jachowski et al.
2007/0158543 A1 7/2007 Clowers et al.
2008/0067361 A1 3/2008 Senko et al.
2008/0111067 A1 5/2008 Glish et al.
2009/0134321 A1 5/2009 Hoyes
2009/0146054 A1 6/2009 Rafferty
2009/0278043 A1 11/2009 Satake et al.
2009/0294655 A1 12/2009 Ding et al.
2010/0084549 A1 4/2010 Ermakov et al.
2011/0147581 A1 6/2011 Chen et al.
2011/0192969 A1 8/2011 Verentchikov
2011/0248160 A1 10/2011 Belov
2011/0284737 A1 11/2011 Makarov et al.
2011/0290995 A1 * 12/2011 Kumph ..... H01J 49/0018 250/282
2012/0256083 A1 * 10/2012 Kovtoun ..... H01J 49/06 250/282
2013/0240724 A1 * 9/2013 Guna ..... H01J 49/4225 250/283
2014/0264006 A1 9/2014 Rafferty et al.
2015/0170898 A1 6/2015 Jiang et al.
2015/0364315 A1 12/2015 Ramsey et al.

OTHER PUBLICATIONS

Abrieux et al., Ion trajectory simulations in a high-pressure cylindrical ion trap, European J. Mass Spectrom., 16(5): 557-565 (2010).
Amini et al., Micro-Fabricated Chip Traps for Ions, in *Atom Chips* (eds. J. Reichel and V. Vuletić), Wiley-VCH Verlag GmbH & Go KGaA, Weinheim, Germany (2011).
Austin et al., Simulations of Ion Trapping in a Micrometer-Sized Cylindrical Ion Trap, J. Am. Soc. Mass Spectrom. 17(3): 430-441 (2006).
Austin et al., Halo Ion Trap Mass Spectrometer, *Anal. Chem.*, 79(7): 2927-2932 (2007).
Badman et al., A Miniature Cylindrical Quadrupole Ion Trap: Simulation and Experiment, Anal. Chem. 70(23): 4896-4901 (1998).
Badman et al., Miniature mass analyzers, J. Mass Spectrom, 35(6): 659-671 (2000).
Badman et al., A Parallel Miniature Cylindrical Ion Trap Array, Anal. Chem., 72(14): 3291-3297 (2000).
Blain et al., Micro Mass Spectrometer on a Chip, Sandia Report SAND2005-6838 (2005).
Blain, Towards the Hand-held Mass Spectrometer: Design Considerations, Simulation, and Fabrication of Micrometer-Scaled Cylindrical Ion Traps, International Journal of Mass Spectrometry, 236:91-104 (2004).
Bonner et al., The Cylindrical Ion Trap. Part 1. General Introduction, International Journal of Mass Spectrometry and Ion Physics, 24(3): 255 269 (1977).
Brewer et al., Planar ion microtraps, Phys. Rev. A 46(11): R6781-R6784 (1992).
Chaudhary et al., Fabrication and testing of a miniature cylindrical ion trap mass spectrometer constructed from low temperature co-fired ceramics, International Journal of Mass Spectrometry, 251: 32-39 (2006).
Chen et al., A Micro Ionizer for Portable Mass Spectrometers using Double-gated Isolated Vertically Aligned Carbon Nanofiber Arrays, IEEE Trans. Electron Devices 58(7): 2149-2158 (2011).
Cheung, Kerry, Chip-Scale Quadrupole Mass Filters for a Micro-Gas Analyzer (Ph.D. Thesis), Massachusetts Institute of Technology, Jun. 2009, 188 pages.
Contreras et al., Hand-Portable Gas Chromatograph-Toroidal Ion Trap Mass Spectrometer (GC-TMS) for Detection of Hazardous Compounds, J Am Soc Mass Spectrom 19(10):1425-1434 (2008).
Cruz et al., Design, microfabrication, and analysis of micrometer-sized cylindrical ion trap arrays, Rev. Sci. Instrum., 78(1): 015107 (2007).
Devoe, Ralph G. "Elliptical ion traps and trap arrays for quantum computation" *Physical Review A* 58(2):910-914 (1998).
Extended European Search Report corresponding to European Patent Application No. 13877607.5 (7 pages) (dated Oct. 5, 2016).
Falconer et al., High Pressure Ion Detection for Miniaturized Mass Spectrometers, Presentation at 58$^{th}$ ASMS Conference 2010, Salt Lake City, UT, May 23, 2010.
Ferran et al., High-pressure effects in miniature arrays of quadrupole analyzers for residual gas analysis from $10^{-9}$ to $10^{-2}$ Torr, Journal of Vacuum Science & Technology A 14:1258 (1996).
Fico et al., Circular Arrays of Polymer-Based Miniature Rectilinear Ion Traps, Analyst, 134(7): 1338-1347, 2009.
Gao et al., Design and Characterization of a Multisource Hand-Held Tandem Mass Spectrometer, Anal. Chem., 80(19): 7198-7205 (2008).
Gao et al., Handheld Rectilinear Ion Trap Mass Spectrometer, Anal. Chem. 78: 5994-6002 (2006).

(56) References Cited

OTHER PUBLICATIONS

Gao, Liang, Miniaturization of the Ion Trap Mass Spectrometer, Ph.D. Thesis, Purdue University, 153 pages (2009).
Goeringer et al., Theory of High-Resolution Mass Spectrometry Achieved via Resonance Ejection in the Qualdrupole Ion Trap, Anal. Chem. 64: 1434-1439 (1992).
Hadjar et al., High-efficiency cross-beam magnetic electron-impact source for improved miniature Mattauch-Herzog mass spectrometer performance, Rev. Sci. Instrum. 83: 064101 (2012).
Hager, A New Linear Ion Trap Mass Spectrometer, Rapid Commun. Mass Spectrom. 16(6): 512-526 (2002).
Harris et al., Ambient Sampling/Ionization Mass Spectrometry: Applications and Current Trends, Anal. Chem. 83: 4508-4538 (2011).
Harris et al., Transportable real-time single-particle ion trap mass spectrometer, Rev. Sci. Instrum. 76: 064102 (2005).
Hood, Development of a Novel Loeb-Eiber Mass Filter, M.S. Thesis, Ohio State University, 158 pages (2009).
Huang et al., Direct analysis of melamine in complex matrices using a handheld mass spectrometer, Analyst, 135: 705-711 (2010).
International Search Report and Written Opinion for PCT/US2013/042031, dated Mar. 6, 2014.
Keil et al., Ambient Mass Spectrometry with a Handheld Mass Spectrometer at High Pressure, Anal. Chem., 79: 7734-7739 (2007).
Knight, The Development of a Micro-Faraday Array for Ion Detection, International Journal of Mass Spectrometry, 215(1-3): 131-139 (2002).
Kornienko et al., Electron impact ionization in a microion trap mass spectrometer, Rev. Sci. Instrum., 70(10): 3907-3909 (1999).
Kornienko et al., Micro Ion Trap Mass Spectrometry, Rapid Commun. Mass Spectrom. 13: 50-53 (1999).
Lammert, Design, Optimization and Initial Performance of a Toroidal FR Ion Trap Mass Spectrometer, International Journal of Mass Spectrometry, 212(1-3): 25-40 (2001).
Lammert et al., Experimental Investigation into the Performance of Ion Traps Using Air Versus Helium as the Buffer Gas, Rapid Communications in Mass Spectrometry, 10(3): 361-371 (1996).
Lammert et al., Miniature Toroidal Radio Frequency Ion Trap Mass Analyzer, Journal of the American Society for Mass Spectrometry, 17(7): 916-922 (2006).
Lee et al. "Simulation of Duty Cycle-Based Trapping and Ejection of Massive Ions Using Linear Digital Quadrupoles: the Enabling Technology for High Resolution Time-of-Flight Mass Spectrometry in the Ultra High Mass Range" *International Journal of Mass Spectrometry* 304(1):36-40 (2011).
Li et al, Ion Trap Array Mass Analyzer: Structure and Performance, Anal. Chem. 81: 4840-4846 (2009).
Londry et al. "Mass Selective Axial Ion Ejection from a Linear Quadrupole Ion Trap" *Journal of the American Society for Mass Spectrometry* 14(10):1130-1147 (2003).
Maas et al., Miniature Monolithic Rectilinear Ion Trap Arrays by Stereolithography on Printed Circuit Board, Journal of Microelectromechanical Systems, 19(4): 951-960 (2010).
Maas et al., RF Planar Ion Trap for Chemical Sensing; Microwave Symposium Digest (MTT), IEEE MTT-S International Conference, 4 pages (2011).
March, Raymond E., An Introduction to Quadrupole Ion Trap Mass Spectrometry, J. Mass Spectrom., 32: 351-369 (1997).
March, Raymond E., Quadrupole Ion Trap Mass Spectrometer, Encyclopedia of Analytical Chemistry, pp. 11848-11872 (2000).
Misharin et al., Development and characterization of a field deployable ion trap mass spectrometer with atmospheric pressure interface, Anal. Chem., 84(22): 10105-10112 (2012).
Moxom et al., Analysis of Volatile Organic Compounds in Air with a Micro Ion Trap Mass Analyzer, Anal. Chem., 75: 6739-6743 (2003).
Moxom et al, Double resonance ejection in a micro trap mass spectrometer, Rapid Commun. Mass Spectrom., 16: 755-760 (2002).
Moxom et al., Sample pressure effects in a micro ion trap mass spectrometer, Rapid Commun. Mass Spectrom., 18: 721-723 (2004).
Orient et al., Miniature, high-resolution, quadrupole mass-spectrometer array, Rev. Sci. Instrum., 68: 1393-1397 (1997).
Ouyang et al., Quadrupole Ion Traps and Trap Arrays: Geometry, Material, Scale Performance, European Journal of Mass Spectrometry, 13(1): 13-18 (2007).
Ouyang et al., Rectilinear Ion Trap: Concepts, Calculations, and Analytical Performance of a New Mass Analyzer, Anal. Chem., 76: 4595-4605 (2004).
Ouyang et al., Handheld Miniature Ion Trap Mass Spectrometers, Anal. Chem., 81(7): 2421-2425 (2009).
Patterson et al., Miniature Cylindrical Ion Trap Mass Spectrometer, Anal. Chem., 74(24): 6145-6153 (2002).
Pau et al., Microfabricated Quadrupole Ion Trap for Mass Spectrometer Applications, Phys. Rev. Lett. 96: 120801 (2006).
Pau et al., Planar Geometry for Trapping and Separating Ions and Charged Particles, Anal. Chem., 79: 6857-6861, 2007.
Peng et al., New Approaches to Miniaturizing Ion Trap Mass Analyzers, Trends Anal. Chem., 30(10): 1560-1567 (2011).
Peng et al., Coaxial Ion Trap Mass Spectrometer: Concentric Toroidal and Quadrupolar Trapping Regions, Anal. Chem., 83(14): 5578-5584 (2011).
Schwartz et al., A Two-Dimensional Quadrupole Ion Trap Mass Spectrometer, Journal of the American Society for Mass Spectrometry, 13(6): 659-669 (2002).
Shiea, Jentaie, Ionization methods for miniature mass spectrometers, Presentation at PITTCON, 2012, Orlando, FL, Mar. 14, 2012.
Sokol et al., Miniature mass spectrometer equipped with electrospray and desorption electrospray ionization for direct analysis of organics from solids and solutions, Int. J. Mass Spectrom., 306: 187-195 (2011).
Song et al., Novel Linear Ion Trap Mass Analyzer Composed of Four Planar Electrodes, Journal of the American Society for Mass Spectrometry, 17(4): 631-639 (2006).
Song, Qingyu, Development of Mass Spectrometers using Rectilinear Ion Trap Analyzers, Ph.D. Thesis, Purdue University, 216 pages, 2008.
Syms, R.R.A., Advances in microfabricated mass spectrometers, Anal. Bioanal. Chem., 393: 427-429 (2009).
Taylor et al., A Simplified Toroidal Ion Trap Mass Analyzer, International Journal of Mass Spectrometry, 321-322: 25-32 (2012).
Teloy et al. "Integral Cross Sections for Ion-Molecule Reactions. I. The Guided Beam Technique" *Chemical Physics* 4:417-427 (1974).
Telrandhe, Mangesh, Fabrication and testing of a cylindrical ion trap microarray for tunable mass spectrometers, Graduate Thesis and Dissertation, University of South Florida, 86 pages (2004).
Van Amerom et al., Microfabrication of Cylindrical Ion Trap Mass Spectrometer Arrays for Handheld Chemical Analyzers, Chem. Eng. Comm., 195: 98-114 (2008).
Wang et al. "Increasing the Trapping Mass Range to $m/z=10^9$—A Major Step Toward High Resolution Mass Analysis of Intact RNA, DNA and Viruses" *International Journal of Mass Spectrometry* 328-329:28-35 (2012).
Wells et al., A Quadrupole Ion Trap with Cylindrical Geometry Operated in the Mass-Selective Instability Mode, Anal. Chem., 70(3): 438-444 (1998).
Whitten et al., High-pressure ion trap mass spectrometry, Rapid Commu. Mass Spectrom. 18: 1749-1752 (2004).
Wilcox et al. "Improved Ion Extraction from a Linear Octopole Ion Trap: SIMION Analysis and Experimental Demonstration" *Journal of the American Society for Mass Spectrometry* 13:1304-1312 (2002).
Wolfe et al., RF amplifier optimization for improved resolution | microscale cylindrical ion traps, Presentation at 59$^{th}$ ASMS Conference 2011, Denver, CO, Jun. 5, 2011.
Xu et al., Ion Trap Mass Analysis at High Pressure: A Theoretical View, J. Am. Soc. Mass Spectrom, 20: 2144-2153 (2009).
Xu et al., Nondestructive Ion Trap Mass Analysis at High Pressure, Anal. Chem. 83(3): 685-689 (2011).
Yang et al., Development of a Palm Portable Mass Spectrometer, Journal of the American Society for Mass Spectrometry, 19(10): 1442-1448 (2008).

(56) References Cited

OTHER PUBLICATIONS

Yu et al. "Miniature Paul-Straubel ion trap with well-defined deep potential well" *Proceedings of the National Academy of Sciences USA* 86:5672 (1989).
Zhang et al., Paul Trap Mass Analyzer Consisting of Opposing Microfabricated Electrode Pairs, Anal. Chem., 81: 5241-5248 (2009).

* cited by examiner

200

200

200

| PRESSURE (mtorr) | 202 | 400 | 600 | 801 | 1002 |
|---|---|---|---|---|---|
| IONIZATION TIME (ms) | 5 | 20 | 50 | 50 | 50 |
| EMITTER CURRENT (A) | 1.70 | 1.70 | 1.74 | 1.77 | 1.79 |
| EMITTER BIAS (V) | 70 | 110 | 125 | 125 | 125 |
| AXIAL rf (Vpp) | 0.6 | 1.0 | 2.0 | 2.5 | 4.0 |

Fig. 11

MINIATURE CHARGED PARTICLE TRAP WITH ELONGATED TRAPPING REGION FOR MASS SPECTROMETRY

RELATED APPLICATIONS

This application is a continuation of U.S. patent application Ser. No. 15/600,325, filed May 19, 2017, which is a continuation of U.S. patent application Ser. No. 14/980,268, filed Dec. 28, 2015, which is a continuation of U.S. patent application Ser. No. 14/456,686, filed Aug. 11, 2014, which is a continuation of U.S. patent application Ser. No. 13/840,653, filed Mar. 15, 2013, the contents of which are hereby incorporated herein by reference in their entirety.

STATEMENT REGARDING FEDERALLY SPONSORED RESEARCH OR DEVELOPMENT

This invention was made with government support under W911NF-10-1-0447 awarded by the U.S. Army Research Office. The government has certain rights in the invention.

BACKGROUND

This Background section is provided for informational purposes only, and does not constitute and admission that any of the subject matter contained herein qualifies as prior art to the present application.

Mass spectrometry (MS) is among the most informative of analytical techniques. Due to its combination of speed, selectivity, and sensitivity MS has wide ranging applications in areas such as trace elemental analysis, biomolecule characterization in highly complex samples, and isotope ratio determination. However, the large size, weight, and power consumption (SWaP) found in some MS systems generally limits analyses to the laboratory setting. Applications for which rapid measurements in the field are desirable or where in-lab analyses are not optimal would benefit from the development of hand portable, miniaturized MS systems.

Much of the SWaP and complexity in MS operation lies in the vacuum systems necessary to attain the high vacuums needed for most mass analyzers ($10^{-5}$-$10^{-9}$ torr). Accordingly, one approach to SWaP reduction is the ability to perform MS at higher pressures. Ion traps may be operated at pressures greater than $10^{-4}$ torr so may be used as mass analyzer for miniature systems. However, in some cases, increasing pressures in an ion trap significantly above a few millitorr has a deleterious effect on resolution and signal intensity. The increasing number of collisions with the buffer gas at higher pressures inhibits the ability of the electric field to control the ions' trajectory. Increasing the operating frequency (typically a radio frequency or "RF") of the trap yields fewer neutral collisions per cycle, reducing the negative effects of high pressure operation but may require a corresponding decrease in trap dimensions in order to reduce the required RF voltage amplitude.

SUMMARY

The applicants have realized that simply reducing the dimensions of conventionally sized centimeter scale trap geometries becomes problematic. As the trap size is reduced, the traditional hyperbolic shapes of ion trap electrodes become increasingly difficult to fabricate with conventional machining techniques. To simplify trap geometry, these hyperbolic shapes may be replaced with planar electrodes.

However, a limitation to miniaturizing ion traps is that the ion trapping capacity decreases as the trap dimensions are reduced due to space charge effects. Simulations predict that 1-μm scale traps will have a charge capacity near a single ion.

The applicants have realized that this limitation may be reduced or overcome by providing a miniaturized trap having a trapping cavity that is elongated in one dimension. The increased dimensionality may yield higher storage capacity than similar traps with symmetrical trapping cavities, while maintaining the same ease of fabrication. Accordingly, embodiments of the ion traps described herein may provide both high levels of miniaturization and advantageously large charge capacities.

In one aspect, a miniature electrode apparatus for trapping charged particles is disclosed. In some embodiments, the apparatus includes, along a longitudinal direction: a first end cap electrode; a central electrode having an aperture; and a second end cap electrode.

In some embodiments, the aperture extends through the central electrode along the longitudinal direction and the central electrode surrounds the aperture in a lateral plane perpendicular to the longitudinal direction to define a transverse cavity for trapping charged particles.

In some embodiments, the aperture in the central electrode is elongated in the lateral plane. In various embodiments, the elongated aperture may be characterized in any of the following ways.

In some embodiments, the elongated aperture has a ratio of a major dimension to a minor dimension greater than 1.0, where the major dimension is the distance of the longest straight line traversing the aperture in the lateral plane and the minor dimension is the distance of the longest straight line traversing the aperture in the lateral plane perpendicular to the straight line corresponding to the major dimension. In some such embodiments, the ratio of the major dimension to the minor dimension is greater than 1.5, 2.0, 3.0, 4.0, 5.0, 10.0, 50.0, 100.0, or more. In some embodiments, the minor dimension is less than 10 mm, 5 mm, 1 mm, 0.1 mm, 0.01 mm, 0.001 mm, or less.

In some embodiments, the elongated aperture has a ratio of a major dimension to an average minor dimension greater than 1.0, where the major dimension is the distance of the longest straight line traversing the aperture in the lateral plane and the average minor dimension is the integrated average of the distances along respective straight lines traversing the aperture in the lateral plane perpendicular to the line corresponding to the major dimension at every position along the line corresponding to the major dimension. In some such embodiments, the ratio of the major dimension to the average minor dimension is greater than 1.5, 2.0, 3.0, 4.0, 5.0, 10.0, 50.0, 100.0, or more. In some embodiments, the average minor dimension is less than 10 mm, 5 mm, 1 mm, 0.1 mm, 0.01 mm, 0.001 mm, or less.

In some embodiments, the elongated aperture includes an elongated channel having first and second ends, where the elongated channel has a ratio of a channel length to a channel width greater than 1.0, where the channel length is the distance of the shortest curve traversing the channel in the lateral plane from the first end to the second end, and the channel width is the distance of the largest straight line traversing the channel in the lateral plane perpendicular to the curve corresponding to the channel length. In some such embodiments, the ratio of the channel length to the channel width is greater than 1.5, 2.0, 3.0, 4.0, 5.0, 10.0, 50.0, 100.0, or more. In some embodiments, the channel width is less than 10 mm, 5 mm, 1 mm, 0.1 mm, 0.01 mm, 0.001 mm, or less.

In some embodiments, each end cap included s a planar conductive member having a plurality of holes extending through the conductive member along the longitudinal direction. In some embodiments, each planar conductive member extends laterally relative to the longitudinal axis and is configured to be electron or ion transmissive.

In some embodiments, each planar conductive member is a conductive mesh.

In some embodiments, a projection of the conductive mesh along the longitudinal axis onto the central electrode completely encompasses the elongated aperture in the central electrode in the lateral plane.

In some embodiments, each end cap electrode includes a conductive material having an aperture to define a path for the charged particles along the longitudinal direction through the apertures of the end cap and central electrodes. In some embodiments, the aperture in at least one end cap is substantially filled with a conductive mesh In various embodiments, the aperture in at least one end cap may have any suitable shape. In some embodiments, the aperture in at least one end cap includes a circular aperture having a circumference greater than the major dimension of the aperture in the central electrode, where the major dimension is defined in any of the ways set forth above. In some embodiments, the aperture in at least one end cap includes a circular aperture having a circumference greater than the channel length of the aperture in the central electrode. In some embodiments, the aperture in at least one end cap includes an elongated slit.

In some embodiments, the elongated aperture in the central electrode may have any suitable shape. In some embodiments, the elongated aperture includes an elongated slit, two or more intersecting elongated slits, a serpentine portion, a spiral portion, a portion of a circular slit, and any combinations thereof.

Some embodiments include, along the longitudinal direction, a first insulating spacer positioned between the first end cap electrode and the central electrode and a second insulating spacer positioned between the central electrode and the second end cap electrode.

Some embodiments include a power supply coupled to the electrodes to provide an oscillating field between the central electrode and the end cap electrodes.

In some embodiments, the transverse cavity defined by the laterally elongated aperture in the central electrode has a vertical dimension in the longitudinal direction from the first end cap to the second end cap of less than about 10 mm, 10 mm, 5 mm, 1 mm, 0.1 mm, 0.01 mm, 0.001 mm, or less. In some embodiments, the transverse cavity defined by the laterally elongated aperture in the central electrode has a vertical dimension that is substantially uniform across the lateral dimensions of the cavity. In some embodiments, the transverse cavity defined by the laterally elongated aperture in the central electrode has a vertical dimension that varies across one or more of the lateral dimensions of the cavity.

In some embodiments, the transverse cavity defined by the laterally elongated aperture in the central electrode has a vertical dimension in the longitudinal direction from the first end cap to the second end cap of that is equal to or greater than the minor dimension, average minor dimension, or channel width of the elongated aperture, as defined above.

In some embodiments, the elongated aperture in the central electrode include at least one channel portion having a lateral length and a lateral width, and the width is substantially uniform along the channel portion.

In some embodiments, the elongated aperture in the central electrode include at least one channel portion having a lateral length and a lateral width, and the width varies along the lateral length of the channel portion.

Some embodiments include at least one mask element configured to block electron or ion transmission to or from a localized region of the transverse cavity.

In some embodiments, the central electrode includes a plurality of apertures, configured to each define a respective transverse cavity for trapping charged particles.

In some embodiments, the elongated aperture includes a serpentine slit in the central electrode having a plurality of substantially straight portions and a plurality of curved portions connecting pairs of the substantially straight portions. Some embodiments include one or more mask elements configured to block ion transmission out of localized regions of the transverse cavity corresponding to the curved portions. Some embodiments include one or more mask elements configured to block ion transmission out of localized regions of the transverse cavity corresponding to the straight portions.

In another aspect, a mass spectrometry apparatus is disclosed including: a miniature electrode assembly for trapping charged particles, the assembly including the apparatus of any of the types described above, along with at least one electrical signal source coupled to the ion trap assembly. In some embodiments, the electrode assembly is configured to produce an electromagnetic field in response to signals from the electrical signal source to produce an ion trapping region located within transverse cavity.

Some embodiments include a controller operatively coupled to the electrical signal source and configured to modulate the signal source to provide mass selective ejection of ions from the trapping region.

In some embodiments, at least one of the endcap electrodes is configured to allow ejection of ions out of the trapping region.

Some embodiments include an ion source configured to inject or form ions to be trapped in the trapping region.

Some embodiments include at least one detector configured to detect ions ejected from the assembly. In some embodiments, the at least one detector includes a Faraday cup detector or an electron multiplier.

In some embodiments, a chamber is provided containing the ion trapping region, wherein, during operation, the chamber is configured to have a background pressure of greater than 100 mtorr, 1 torr, 10 torr, 100 torr, 500 torr, 760 torr, 1000 torr, or more.

In some embodiments, the central electrode includes a plurality of apertures each defining a transverse cavity for trapping charged particles, each cavity containing a separate one of a plurality of ion trapping cavity regions In some embodiments, the mass spectrometry apparatus is configured to generate an enhanced output signal based on a combined mass selective ion ejection output from the plurality of ion trapping cavity regions.

In another aspect, a mass spectrometry method is disclosed including applying an electrical signal a miniature electrode assembly for trapping charged particles, the assembly including a miniature electrode apparatus for trapping charged particles of any of the types described above. Some embodiments include, in response to the electrical signal, producing an electromagnetic field having an ion trapping region located within the cavity of the ion trap assembly. Some embodiments include modulating the signal source to provide mass selective ejection of ions from the trapping region, detecting ions ejected from the trapping region to generate a mass spectrometry signal, and outputting the mass spectrometry signal.

Some embodiments include injecting or forming ions to be trapped in the trapping region. In some embodiments, at least one of the first and second end cap electrodes includes a planar conductive member having a plurality of holes extending through the planar conductive member, the planar conductive member configured to be electron or ion transmissive. In some embodiments, the method includes injecting of ions or electrons into the trapping region through the plurality of holes in the planar conductive member.

Some embodiments include ejecting ions from a localized portion of the trapping region. In some embodiments, the localized portion corresponds to a lateral end portion of the trapping region or a central portion of a trapping region. Some embodiments include forming or injecting ions at a plurality of locations in trapping region; and ejecting ions from substantially a single location in the trapping region.

Some embodiments include forming or injecting ions in a first portion of the trapping region; and ejecting ions from a second portion of the trapping region having a volume that is smaller than that of the first portion. In some such embodiments, the trapping region includes a serpentine region extending between a pair of endpoints with a plurality of substantially straight portions and a plurality of curved portions connecting pairs of the substantially straight portions and the first portion corresponds to one or more of the substantially straight portions while the second portion corresponds to at least one of the curved portions and the endpoints.

Some embodiments include selectively blocking ions ejected from a portion of the trapping region to prevent the ions from being detected. Some embodiments include selectively blocking electrons or ions from a source from entering a portion of the trapping region.

Some embodiments include, in response to the electrical signal producing an electromagnetic field having a plurality of separate ion trapping regions. In some embodiments, at least two of the ion trapping regions have differing ion trapping stability characteristics. In some embodiments, each of the ion trapping regions have substantially the same ion trapping stability characteristics.

Some embodiments include modulating the signal source to provide mass selective ejection of ions from each of the trapping regions. Some embodiments include detecting ions ejected from multiple trapping regions with a single detector to generate a combined mass spectrometry signal. Some embodiments include detecting ions ejected from each of multiple trapping regions with a respective detector to generate a respective mass spectrometry signal.

Various embodiments may include any of the above described elements, either alone or in any suitable combinations.

In various embodiments described herein, a miniature electrode apparatus for trapping charged particles is disclosed. The apparatus includes, along a longitudinal direction: a first end cap electrode; a central electrode having an aperture; and a second end cap electrode. The aperture extends through the central electrode along the longitudinal direction and the central electrode surrounds the aperture in a lateral plane perpendicular to the longitudinal direction to define a transverse cavity for trapping charged particles. The aperture in the central electrode is elongated in the lateral plane. In various embodiments, the elongated aperture may be characterized in any of the following ways.

As described below, e.g., as shown in reference to FIGS. 1-4, and 17 the elongated aperture may take on any arbitrary elongated shape. Referring to FIGS. 18A-18C, the shape may be characterized in any of the following ways.

In some embodiments, the elongated aperture has a ratio of a major dimension to a minor dimension greater than 1.0, where the major dimension is the distance of the longest straight line traversing the aperture in the lateral plane and the minor dimension is the distance of the longest straight line traversing the aperture in the lateral plane perpendicular to the straight line corresponding to the major dimension. In some such embodiments, the ratio of the major dimension to the minor dimension is greater than 1.5, 2.0, 3.0, 4.0, 5.0, 10.0, 50.0, 100.0, or more. In some embodiments, the minor dimension is less than 10 mm, 5 mm, 1 mm, 0.1 mm, 0.01 mm, 0.001 mm, or less.

As shown in FIG. 18A the major dimension of the aperture is defined as the distance of the longest straight line traversing the aperture in the lateral plane and the minor dimension is the distance of the longest straight line traversing the aperture in the lateral plane perpendicular to the straight line corresponding to the major dimension. In some such embodiments, the ratio of the major dimension to the minor dimension is greater than 1.0, 1.5, 2.0, 3.0, 4.0, 5.0, 10.0, 50, 100, or more. In some embodiments, the minor dimension is less than 10 mm, 5 mm, 1 mm, 0.1 mm, 0.01 mm, 0.001 mm, or less. In the case of the slit shaped aperture shown in FIGS. 1A-1E, the major dimension corresponds to $y_o$, while the minor dimension corresponds to $2x_o$ As shown in FIG. 18B, the major dimension of the aperture is defined as the distance of the longest straight line traversing the aperture in the lateral plane and the average minor dimension is the integrated average of the distances along respective straight lines traversing the aperture in the lateral plane perpendicular to the line corresponding to the major dimension at every position along the line corresponding to the major dimension. In some such embodiments, the ratio of the major dimension to the average minor dimension is greater than 1.0, 1.5, 2.0, 3.0, 4.0, 5.0, 10.0, 50, 100, 1000, or more. In some embodiments, the average minor dimension is less than 10 mm, 5 mm, 1 mm, 0.1 mm, 0.01 mm, 0.001 mm, or less.

In some embodiments, as shown in FIG. 18C the elongated aperture is an elongated channel having first and second ends. In such cases, the channel length may be defined as the distance of the shortest curve traversing the channel in the lateral plane from the first end to the second end, and the channel width may be defined as the distance of the largest straight line traversing the channel in the lateral plane perpendicular to the curve corresponding to the channel length. In some such embodiments, the ratio of the channel length to the channel width is greater than 1.5, 2.0, 3.0, 4.0, 5.0, 10.0, 50, 100, 1000, or more. In some embodiments, the channel width is less than 10 mm, 5 mm, 1 mm, 0.1 mm, 0.01 mm, 0.001 mm, or less.

BRIEF DESCRIPTION OF THE DRAWINGS

FIG. 1A is a perspective view.

FIG. 1B is second perspective view at an alternate angle.

FIG. 1C is a top-down view.

FIG. 1D is a side cross sectional view along the plane AA'.

FIG. 1E is a perspective cross sectional view along the plane AA'.

FIG. 2A is a perspective view.

FIG. 2B is a top-down view.

FIG. 2C is an exploded view.

FIG. 8A shows mass spectra of $10^{-4}$ torr Xe with 51 mtorr of He buffer gas taken with the SLIT (upper trace) and CIT (lower trace). The bar graph of the NIST EI spectrum for Xe is shown along the bottom of the graph for reference. The average FWHM of the five major peaks is 0.41 Th and 0.44 Th for the SLIT and CIT respectively.

FIG. 8B shows total integrated Xe signal as a function of sample pressure demonstrating the large increase in sensitivity of the SLIT (upper trace) over the CIT (lower trace). The slopes of the fitted lines are 0.52 μV*s/torr and 1.52 μV*s/torr for the SLIT and CIT respectively yielding a 10 times higher sensitivity for the SLIT. Vertical error bars represent the standard deviation of the spectra taken in triplicate serially at each pressure while horizontal error bars represent the imprecision of the full range pressure gauge.

FIG. 11 shows a table of experimental conditions for the high pressure mass spectra shown in FIG. 10.

FIG. 18A-8C illustrate various method for characterizing the shape on an elongated aperture.

DETAILED DESCRIPTION

In various embodiments, a stretched length ion trap (SLIT) is provided for use, e.g., as a mass analyzer in a mass spectrometry apparatus. The ion trap features a trapping region that is miniaturized along two dimensions, but stretched or elongated along a third dimension.

Figure 1A:
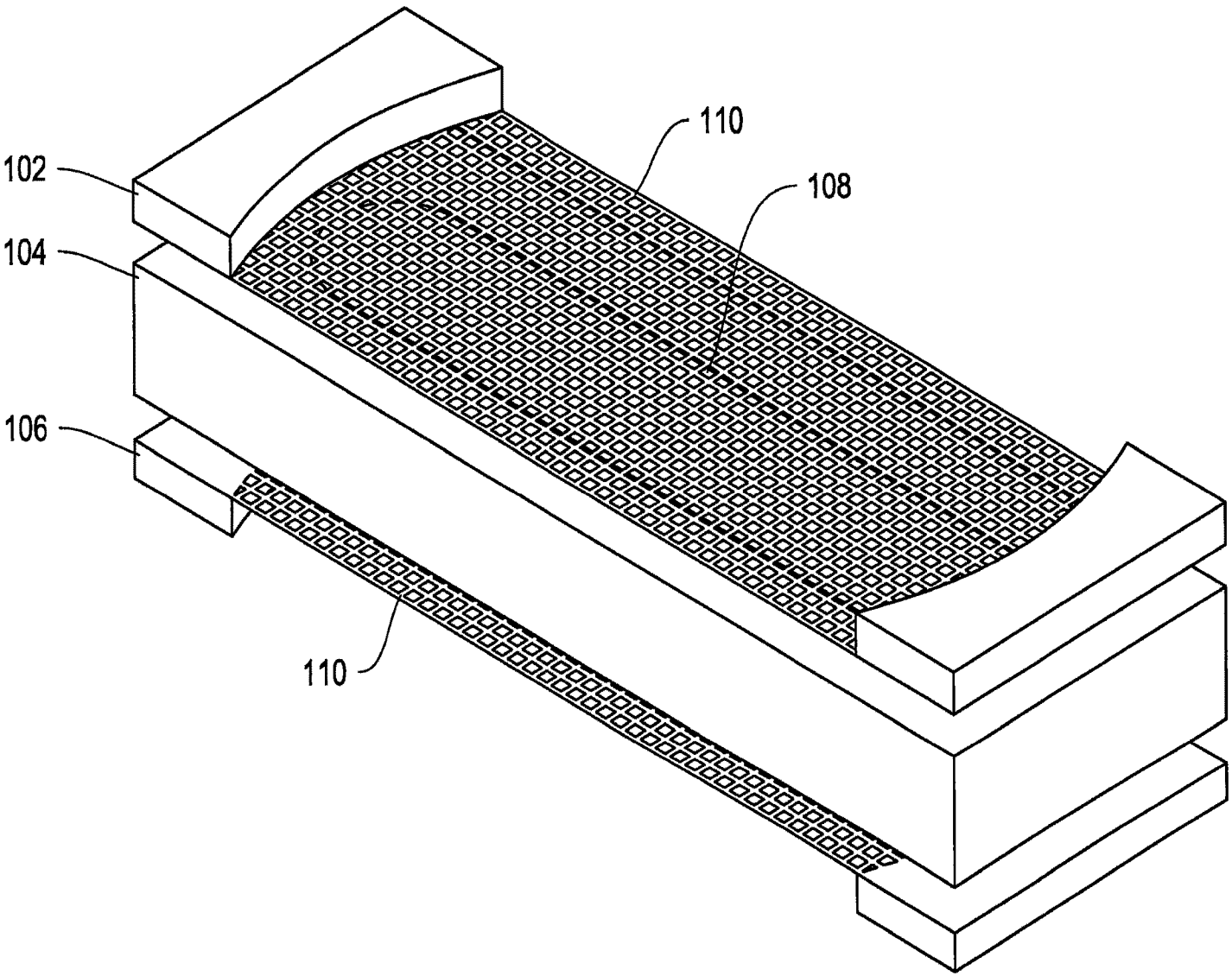
FIGS. 1A-1E show views of a miniature electrode apparatus for trapping charged particles.
Figure 1B:
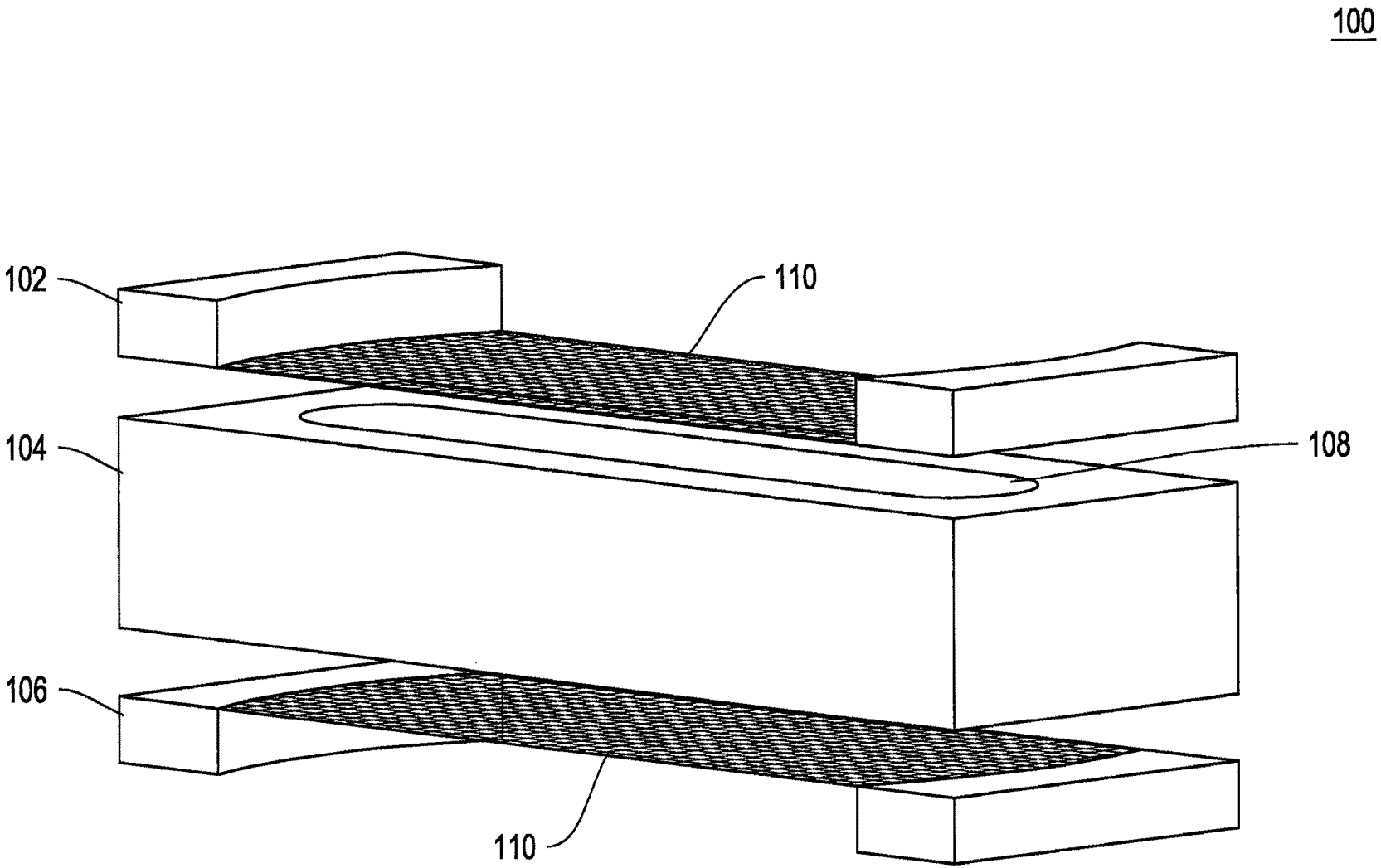
Figure 1C:
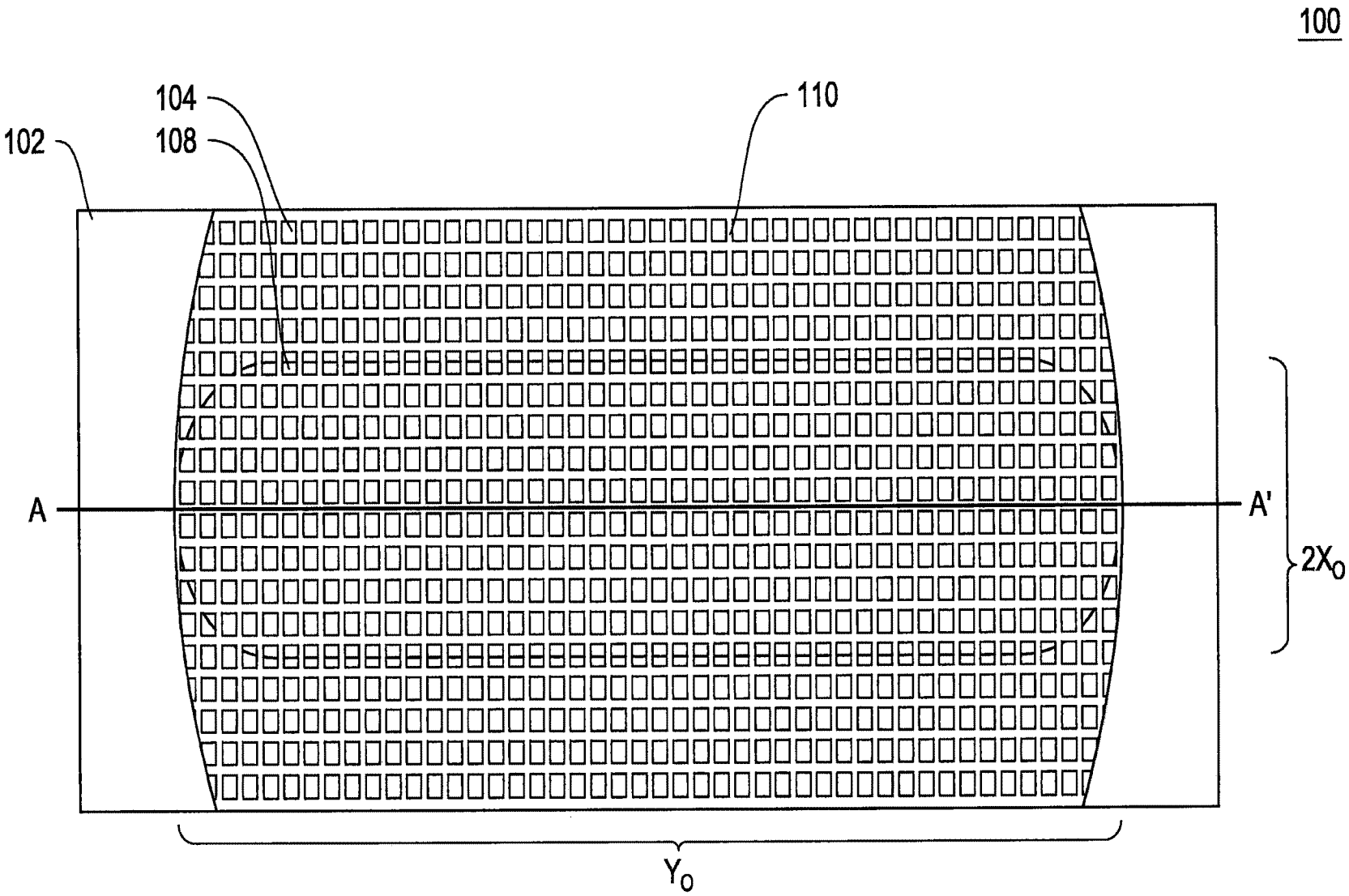
Figure 1D:
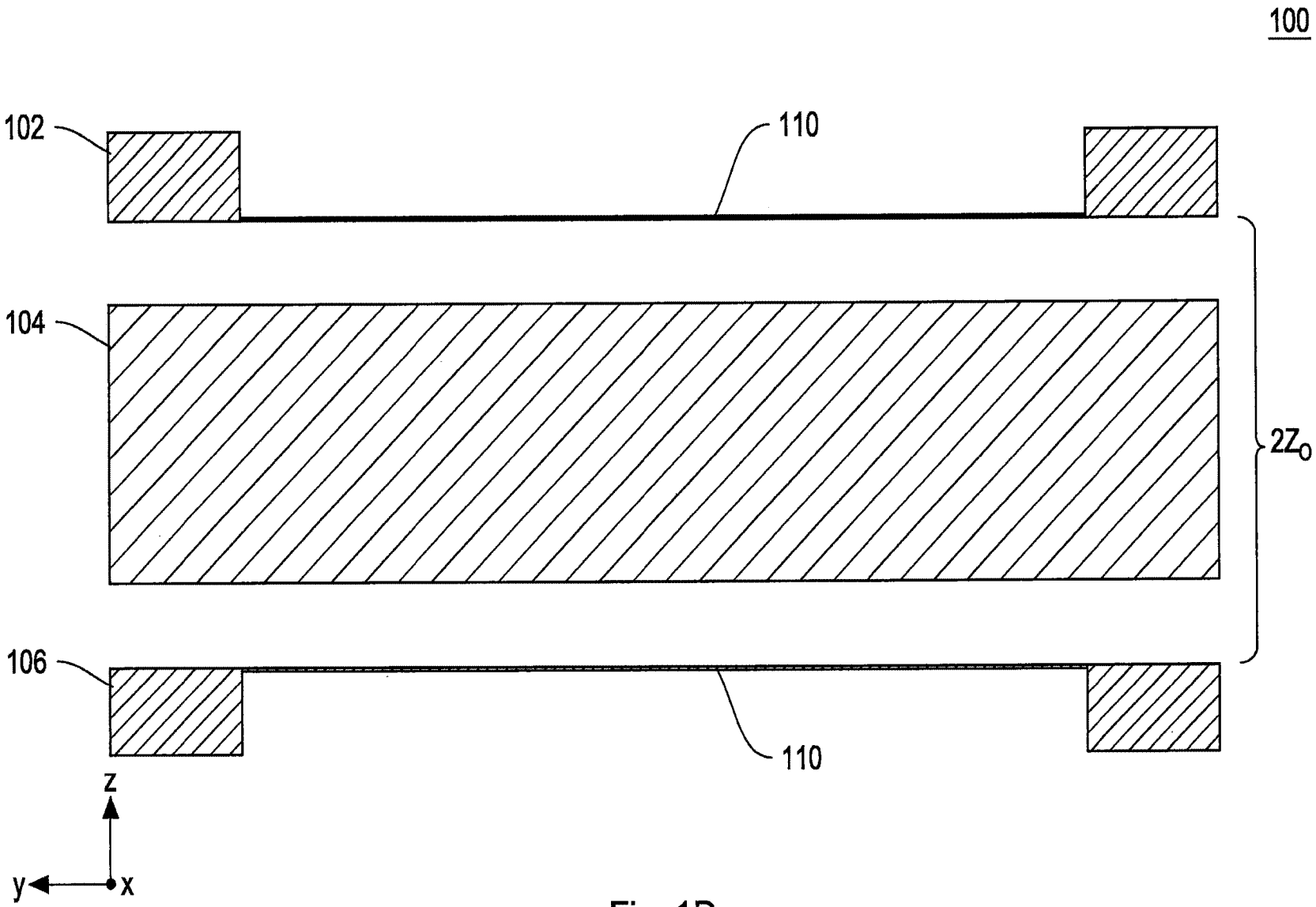
Figure 1E:
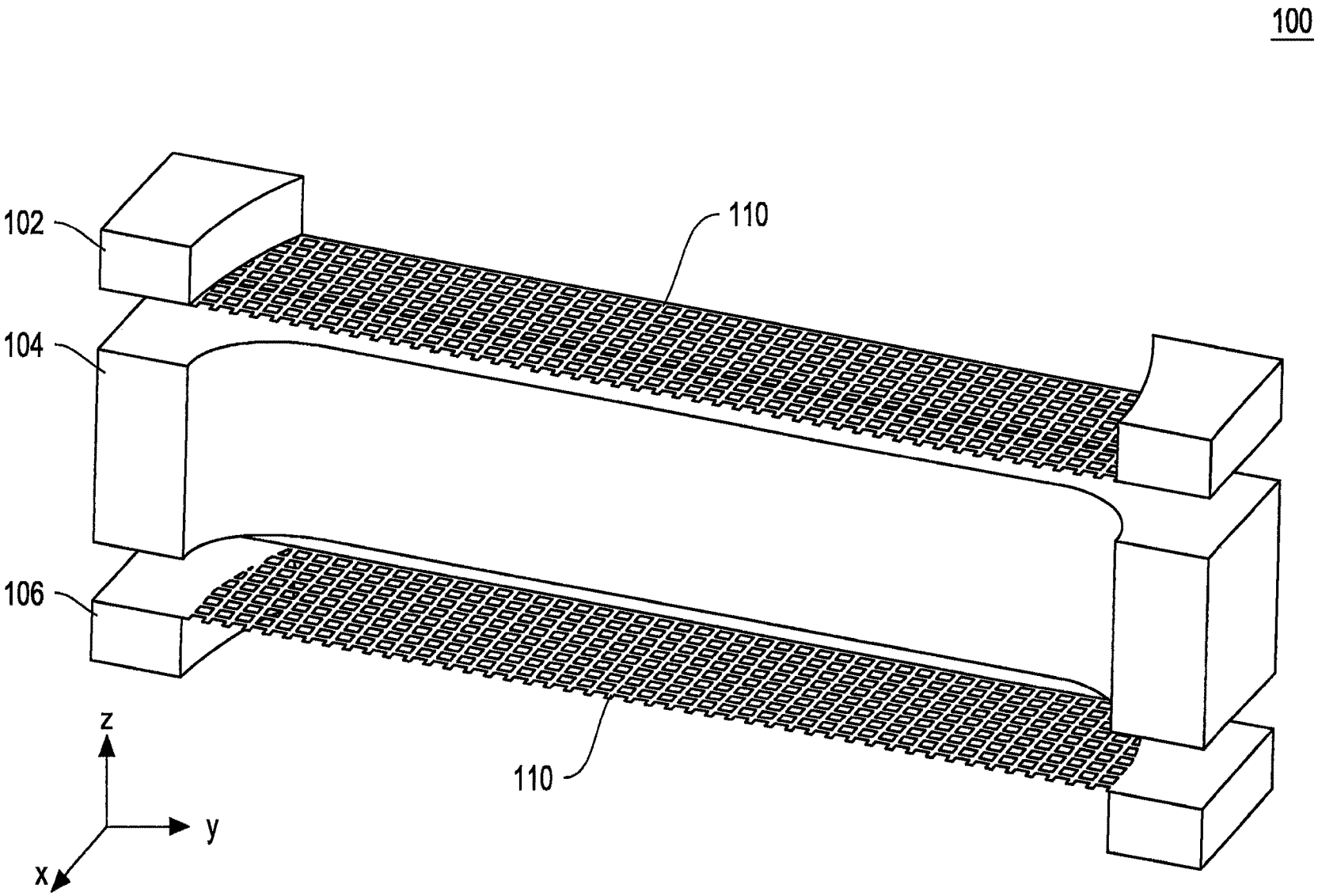

For example, FIGS. 1A-1E show views of a miniature electrode apparatus 100 for trapping charged particles. FIG. 1A is a perspective view. FIG. 1B is second perspective view at an alternate angle. FIG. 1C is a top-down view. FIG. 1D is a side cross sectional view along the plane AA'. FIG. 1E is a perspective cross sectional view along the plane AA'.

The miniature electrode apparatus 100 includes three electrodes stacked along a longitudinal direction (as shown in the figures, the z direction). The electrodes include a first end cap electrode 102, a central electrode 104, and a second cap electrode 106. The central electrode 104 includes an elongated aperture 108. The aperture 108 extends through the central electrode along the longitudinal z direction and the central electrode 104 surrounds the aperture 108 in a lateral plane perpendicular to the longitudinal direction (as shown an x-y plane) to define a transverse cavity for trapping charged particles.

The central and end cap electrodes 102, 104, 106 may be made of any suitable conductive material such as a metal (e.g., copper, gold, stainless steel) or a doped semiconductor material such as highly doped n or p type silicon. The electrodes may be formed using any suitable fabrication technique including, for example, milling, etching (e.g., wet etching), and laser cutting.

The aperture 108 is "stretched" or elongated in the lateral plane. For example, as shown the aperture 108 is an elongated slit that is longer in the y direction that in the x direction.

In various embodiments, the aperture 108 may take any elongated shape. For example, in various embodiments, the aperture has a major dimension that is the largest straight distance traversing the aperture in the lateral plane and a minor dimension that is the largest straight distance traversing the aperture in the lateral plane perpendicular to the major dimension. In the examples shown in FIGS. 1A-1E the major dimensions corresponds to the length $y_0$, while the minor dimension corresponds to the distance $2x_0$ (best shown in FIG. 1C). Note that by convention, $x_0$ is defined herein as the half width of the aperture, while $y_0$ is the full length of the aperture.

In some embodiments, the ratio of a major dimension to a minor dimension greater than 1.0, 1.5, 2.0, 3.0, 4.0, 5.0, 10.0, 20.0, 30.0, 40.0, 50.0, 100.0, 150, 200, or more. For example, in some embodiments, the ratio of a major dimension to a minor dimension is in the range of 1.1-1000, or any subrange thereof.

The electrode apparatus 100 may be miniature, e.g., to allow charge particle trapping operation at relative high frequency. For example, in some embodiments, the minor dimension of the aperture 108 is less than 50 mm, 10 mm, 5 mm, 4, mm, 3 mm, 2 mm, 1.0 mm, 0.1 mm, 0.01 mm, 0.05 mm, or 0.001. For example in some embodiments, the minor dimension is in the range of 0.001 mm-50 mm, or any subrange thereof. In some embodiments, the minor dimension is sufficiently small that the electrode apparatus operates to trap only a line or plane of single charged particles extending along the major dimension.

In some embodiments, the transverse cavity defined by the laterally elongated aperture 108 in the central electrode 104 has a vertical dimension $2z_0$ (best shown in FIG. 1D) of less than about 10 mm. 50 mm, 10 mm, 5 mm, 4, mm, 3 mm, 2 mm, 1.0 mm, 0.1 mm, 0.01 mm, 0.05 mm, or 0.001. Note that $z_0$ has been defined as the half height of the cavity, e.g., as shown, the half height of the aperture 108 plus the distance from the aperture to the end cap electrode. For example in some embodiments, the minor dimension is in the range of 0.001 mm-50 mm, or any subrange thereof. In some embodiments, the minor dimension is sufficiently small that the electrode apparatus operates to trap only a single charged particle along the vertical dimension. In some embodiments, the ratio of $z_0$ to $x_0$ is grater than one, e.g., in the range of 1.1-1.3, In various embodiments, the end cap electrodes 102 and 106 are at least partially transmissive to charged particles, to allow such particles to be loaded into or ejected from the transverse cavity.

For example, as shown, each end cap electrode 102 and 106 includes a planar conductive member 110 having a plurality of holes extending through the conductive member along the longitudinal direction. As shown, each planar conductive member 110 extends laterally relative to the longitudinal axis and is configured to be electron or ion transmissive.

In some embodiments, the planar conductive member 110 is a conductive mesh, such as an electroformed mesh or woven mesh. In various embodiments, the openness of the mesh (i.e., the percentage of the area of the mesh surface that includes passages extending therethrough) may be selected to provide a desired transmissivity to charged particles and a desired mechanical strength. In some embodiments, the mesh may be at least 50% open, at least 75% open, at least 80% open, at least 90%, or more. For example, in some embodiments the openness of the mesh is in the range of 1%-99%, or any subrange thereof.

Figure 3:
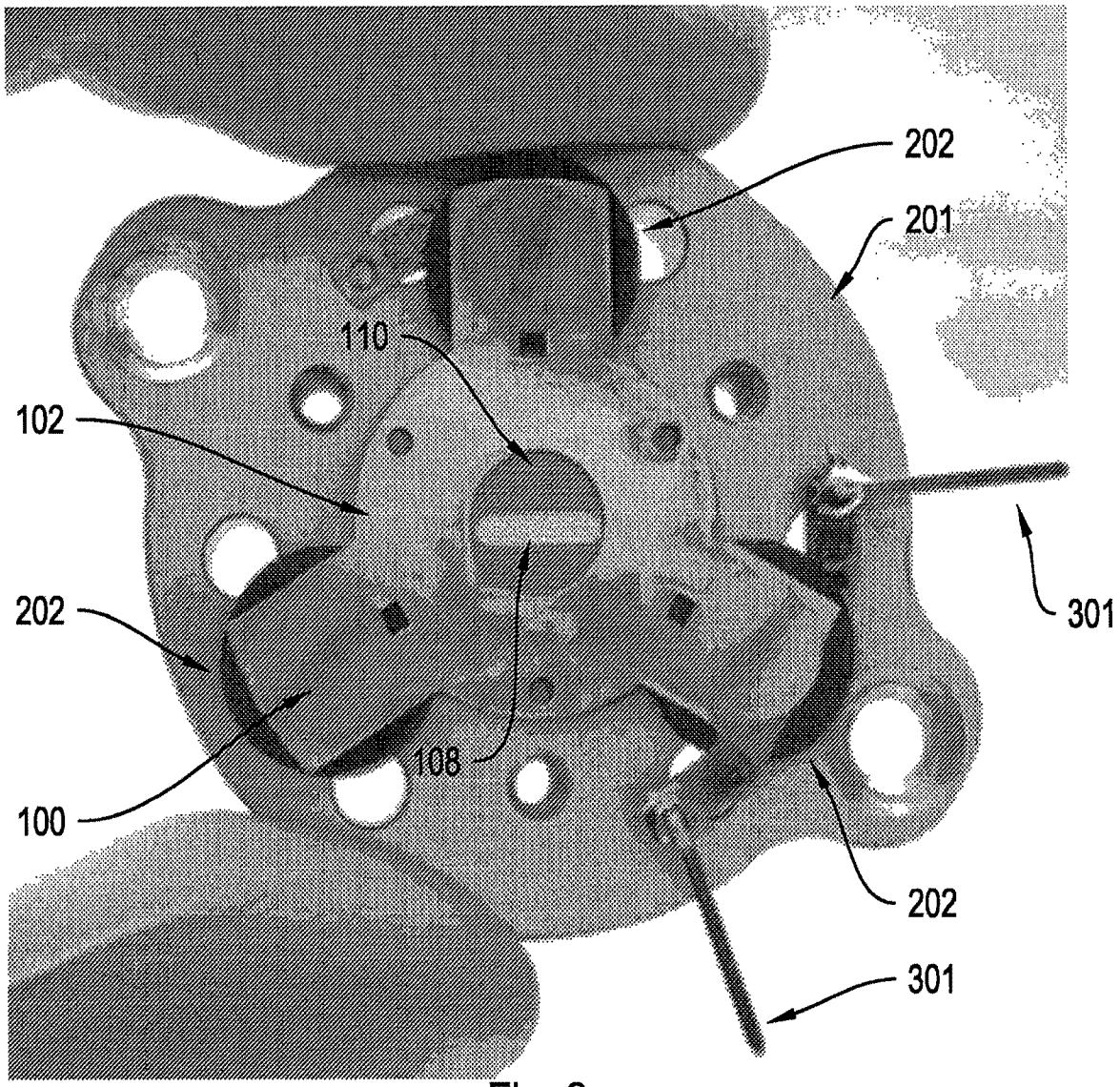
FIG. 3 is a photograph of an ion trap including a miniature electrode apparatus for trapping charged particles.

In some embodiments, the use of the mesh 110 in the end cap electrodes 102 and 106 is advantageous, as it may reduce the need for precise alignment of the electrodes 102, 104, and 106. For example, as best shown in FIG. 1C, for each end cap electrode 102 and 106, a projection of the conductive mesh 110 along the longitudinal axis onto the central electrode completely encompasses the elongated aperture 108 in the central electrode 104 in the lateral plane. As shown, the mesh portions 110 of the end cap electrodes 102 and 106 are shaped as an elongated slit that is wider and longer than the aperture 108 in the central electrode 104. Note that in the configuration shown, the length of the mesh portions 110 is approximately equally to the length of the aperture, however, in other embodiments, the mesh portions may be longer (or shorter) than the aperture 108 in the central electrode 104. In various embodiments other shapes or configurations may be used. For example, as shown in FIG. 3, the mesh may be positioned in a circular aperture in the endcap electrode 102 or 106 having a diameter greater than the major dimension of the aperture 108 in the central electrode 104.

In embodiments of the type described above, misalignments such as lateral shifts in the x-y direction and/or rotations about the longitudinal axis will not substantially impact the operation of the ion trap. That is, because of the relatively homogeneous nature of the mesh 110, the structure of the portion of the end cap electrode 102 or 106 facing the elongated aperture 108 in the central electrode 104 is unchanged by such misalignments. Accordingly, in some embodiments, the performance of the ion trap depends primarily or exclusively on the vertical alignment of the electrodes 102, 104, and 106. As detailed below, in some embodiments, proper vertical alignment may be maintained easily using, e.g., non-conductive spacer elements positions between the electrodes.

Although the use of a mesh 110 may be advantageous, in some embodiments it may be omitted, and one or both of the end cap electrodes 102 and 106 may simply include an unfilled aperture. This aperture may have any suitable shape (e.g. an elongated slit or cylindrical aperture). In various embodiments, the aperture in the end cap 102 or 106 may have a shape that substantially corresponds to or substantially differs from the shape of the aperture 108 in the central electrode 104. In some embodiments, the aperture in the end caps 102 and 106 may have a shape in the lateral plane that is similar to the aperture 108 in the central electrode 104 but with a length in the x-direction smaller than the corresponding length of the aperture 108. For example, in the embodiments shown in FIGS. 2A-2C, each of the electrodes 102, 104, and 106 include an elongated slit aperture, and the slits are aligned.

In the embodiments shown in FIGS. 1A-1E, the transverse cavity defined by the laterally elongated aperture 108 in the central electrode 104 has a vertical dimension $2z_0$ (corresponding to the end cap to end cap spacing) that is substantially uniform across the lateral x and y dimensions of the cavity. However, it is to be understood that in some embodiments, the transverse cavity defined by the laterally elongated aperture 108 in the central electrode 104 may have a vertical dimension that varies across one or more of the lateral dimensions of the cavity, e.g., in the case where one of the end cap electrodes 102 or 106 is positioned at an angle relative to the central electrode 104. In some cases, this arrangement is disadvantageous in that the alignment variations in the vertical dimension of the cavity may lead to a loss of resolution when operated as a mass analyzer. However in other cases (e.g., as described below where trapped particles are selectively ejected from a localized region of the trapping cavity), this arrangement may be advantageous.

In general, the shape of the apertures in each electrode may be modified as required for a given application. For example, in some embodiments, the elongated aperture 108 in the central electrode 104 includes at least one channel portion having a lateral length and a lateral width. In some cases, the width may be substantially uniform along the channel portion, while in other cases, the width varies along the lateral length of the channel portion.

Figure 2A:
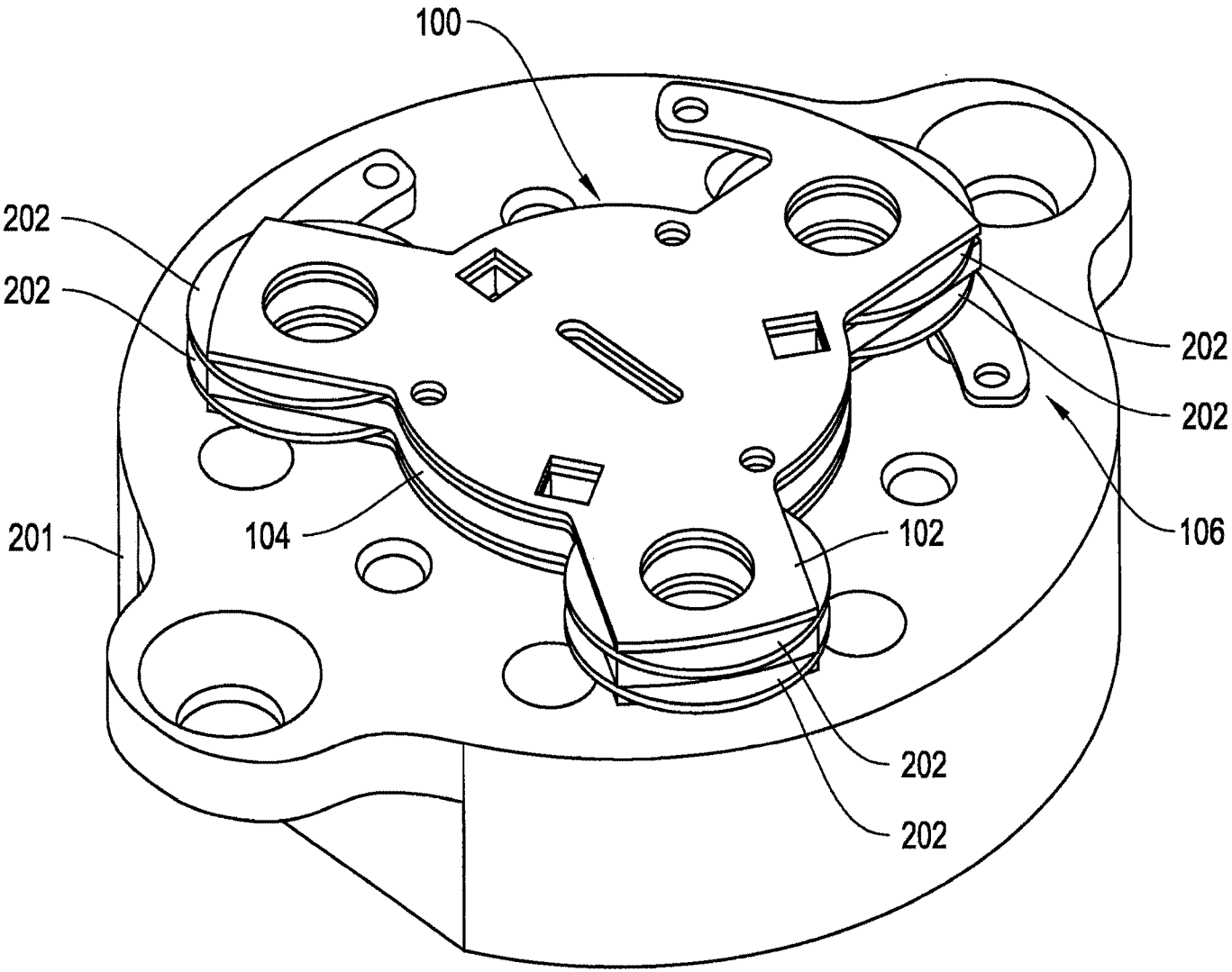
FIGS. 2A-2C show views of an ion trap including a miniature electrode apparatus for trapping charged particles.
Figure 2B:
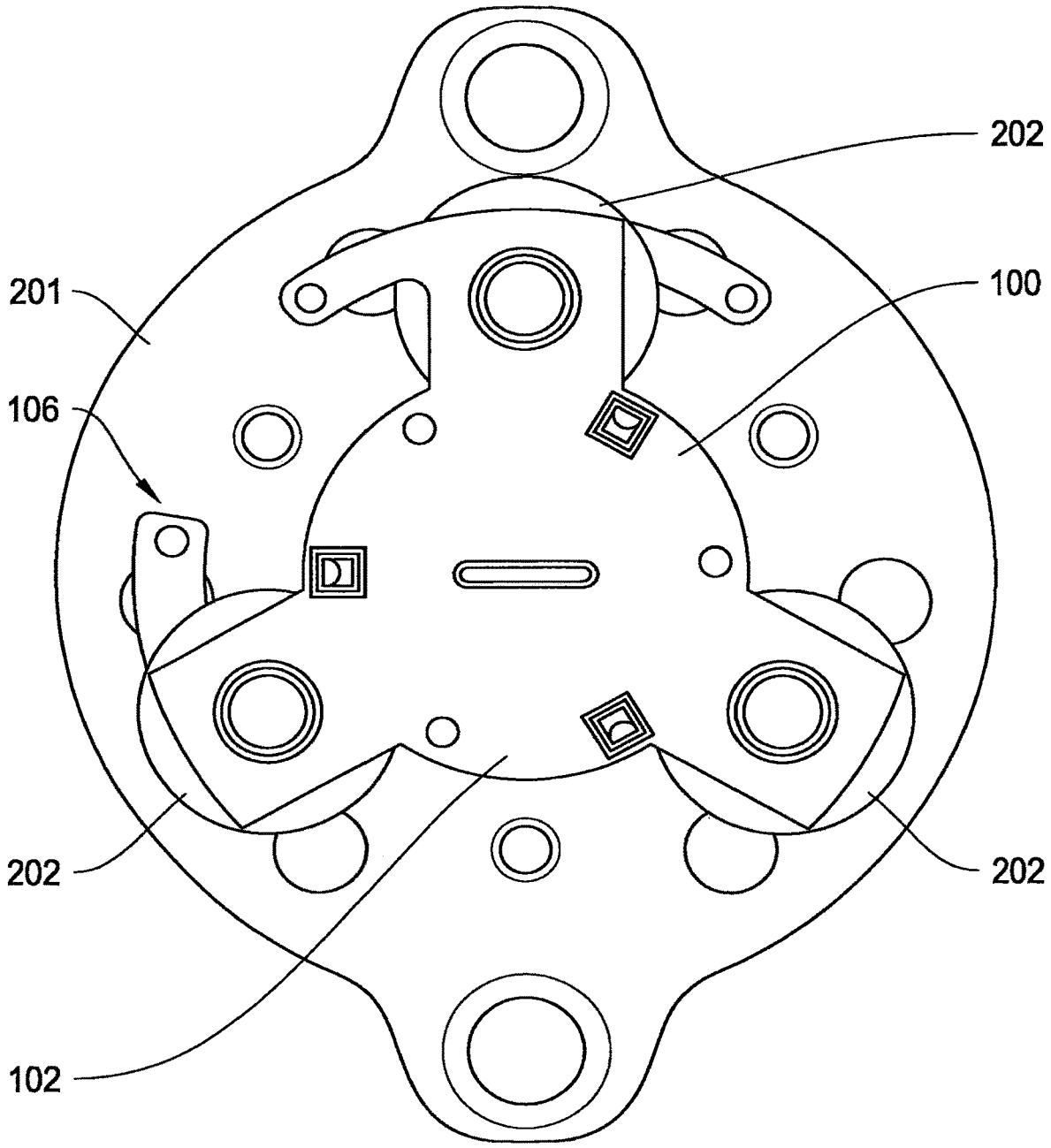
Figure 2C:
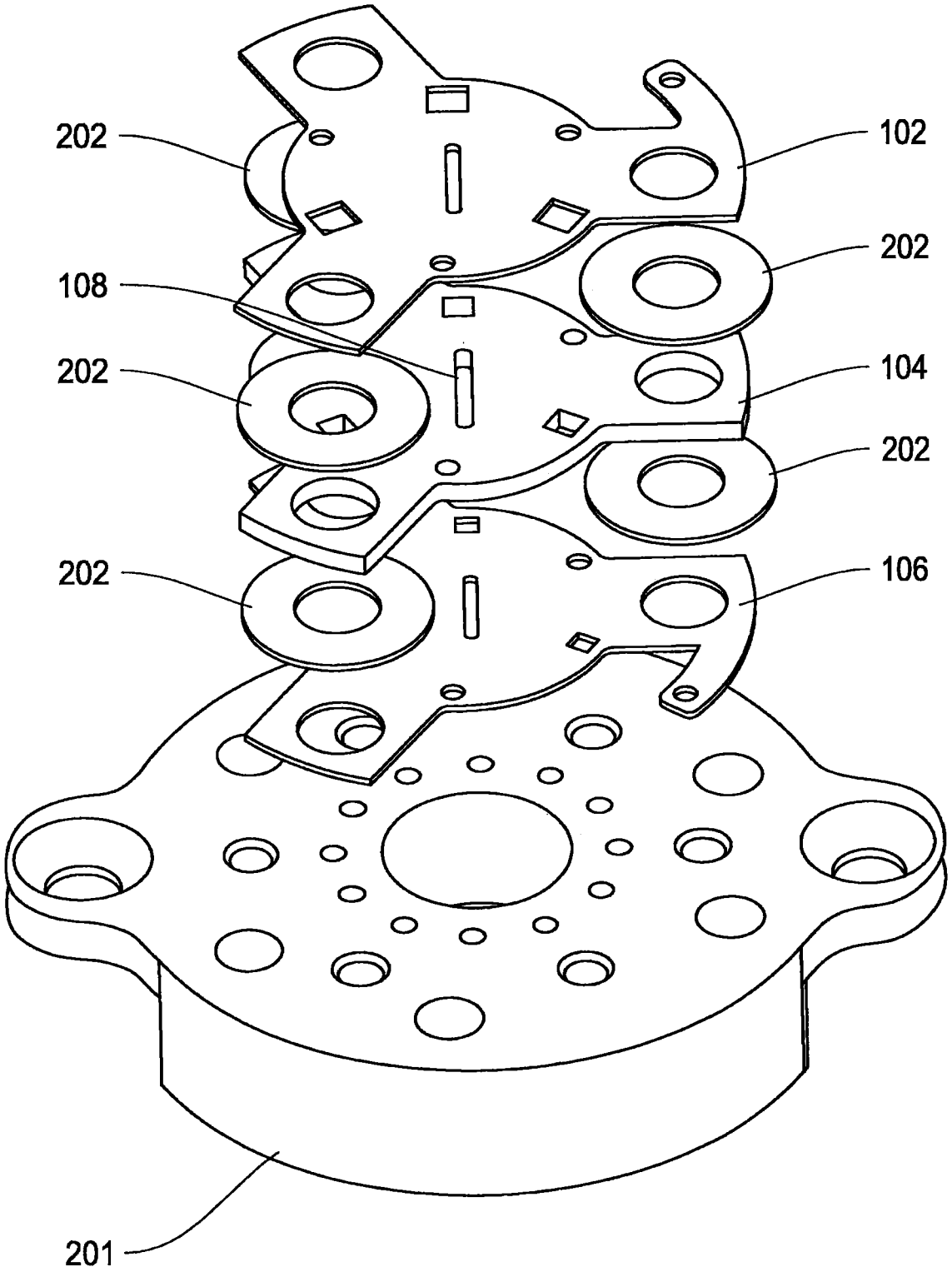

FIGS. 2A-2C show views of an ion trap assembly 200 including a miniature electrode apparatus 100 for trapping charged particles. FIG. 2A is a perspective view. FIG. 2B is a top-down view. FIG. 2C is an exploded view.

As in FIGS. 1A-1E, the miniature electrode apparatus 100 includes a first end cap electrode 102, a central electrode 104, and a second exit cap electrode 106. The central electrode 104 includes an elongated aperture 108. The aperture 108 extends through the central electrode 104 along the longitudinal z direction and the central electrode 104 surrounds the aperture 108 in a lateral plane perpendicular to the longitudinal direction (as shown an x-y plane) to define a transverse cavity for trapping charged particles.

The apparatus 100 is disposed on a support member 201. Non-conductive spacers 202 are provided to space apart the electrodes 102, 104, and 106. Any suitable non-conductive material may be used in the spacers 202, e.g. a polymer film such as a polyimide, polyamide, kapton, or teflon film, or insulating materials such as ceramics or mica. In other embodiments, the non-conductive material may be grown or deposited on one or more of the electrodes, e.g., using techniques known in the field of semiconductor processing, e.g., the growth of silicon oxide or silicon nitride films. Although six spacers 202 are shown, in various embodiments, any suitable number may be used.

The sandwich structure made up of the electrodes 102, 104, 106 and the spacers 202 may be fastened to the support member 201 using any suitable attachment facility, e.g., one or more screws extending through the sandwich structure into the support member 201. In some embodiments, the screws may be disposed symmetrically about the longitudinal axis of the sandwich structure, and tightened with equal torque to maintain parallel alignment of the electrodes 102, 104, 106.

In some embodiments, the support member 201 may include one or more alignment features to aid in mounting the apparatus 100. For example, in some embodiments the support member 201 may include one or more holes for mounting guide posts. The electrodes 102, 104, and 106 may then include guide holes that allow the electrodes to be slipped over the guide posts to maintain a desired alignment during assembly. In some embodiments, these guide posts may be removed after the electrodes are fastened to the support member 201.

FIG. 3 is a photograph of an ion trap 200 including a miniature electrode apparatus 100 for trapping charged particles. As mentioned above, in the embodiment shown, the mesh 110 in the end cap electrodes 102 and 106 are positioned in a circular aperture in the endcap electrodes 102 and 106 having a diameter greater than the major dimension of the aperture 108 in the central electrode 104. Electrical connections 301 to the end cap electrodes 102 and 106. As shown, the connection is a solder connection to the trapping electrodes, but in various embodiments any suitable connection may be used.

Figure 4:
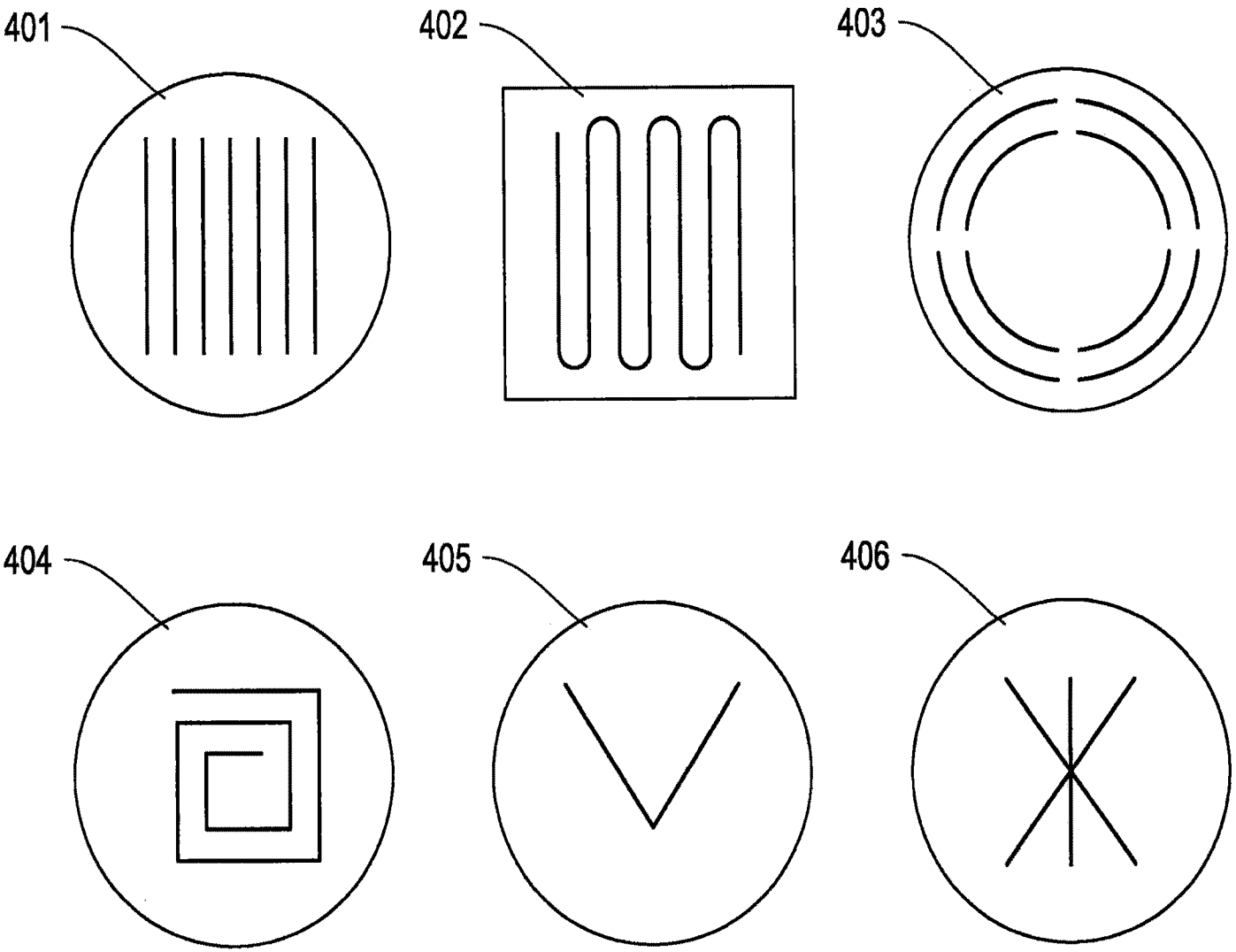
FIG. 4 shows schematic diagrams of several alternative designs for the central electrode of a miniature electrode apparatus of the type shown in FIGS. 1A-1E.

Although the examples above feature a single elongated aperture 108 formed as a slit in the central electrode 104, in other embodiments, other aperture shapes and/or more than one aperture may be provided. FIG. 4 shows schematic diagrams of several alternative designs for the central electrode of a miniature electrode apparatus of the type shown in FIGS. 1A-1E.

Central electrode 401 includes a plurality of apertures, each defining a separate transverse cavity for trapping charged particles. As shown the apertures are elongated slits laid out in a regular linear array. However, in various embodiments other aperture shapes and arrangements may be used including two dimension arrays of apertures or irregular or randomly positioned apertures.

Central electrode 402 includes a serpentine shaped aperture. As shown, the serpentine shape includes relatively long straight portions connected by relatively short curves portions. The serpentine shape is advantageous in that it can provide a trapping cavity with a very long effective length (i.e., the length the aperture would have if the serpentine shape was straightened out.) while still fitting in a relatively compact footprint.

Similarly, central electrode 404 includes a spiral shaped aperture. Central electrode 403 includes a plurality of slit shaped apertures formed as portions of circles. In various embodiments, other curved apertures shapes may be used.

In some embodiments, e.g., the central electrode may include one or more intersecting slit shaped aperture. For example, central electrode 405 has two slits intersecting at a common endpoint. Central electrode 406, has three intersecting slits arranged in a star shape. In various embodiments, any suitable number and arrangement of intersecting slits may be used.

Note that in various embodiments, the slit shaped portions of the apertures may have any suitable shape. For example, the vertical height, lateral length and lateral width of the slits may be substantially uniform. In some embodiments, one or more of the vertical height, lateral length and lateral width of the slits may vary.

Figure 5A:
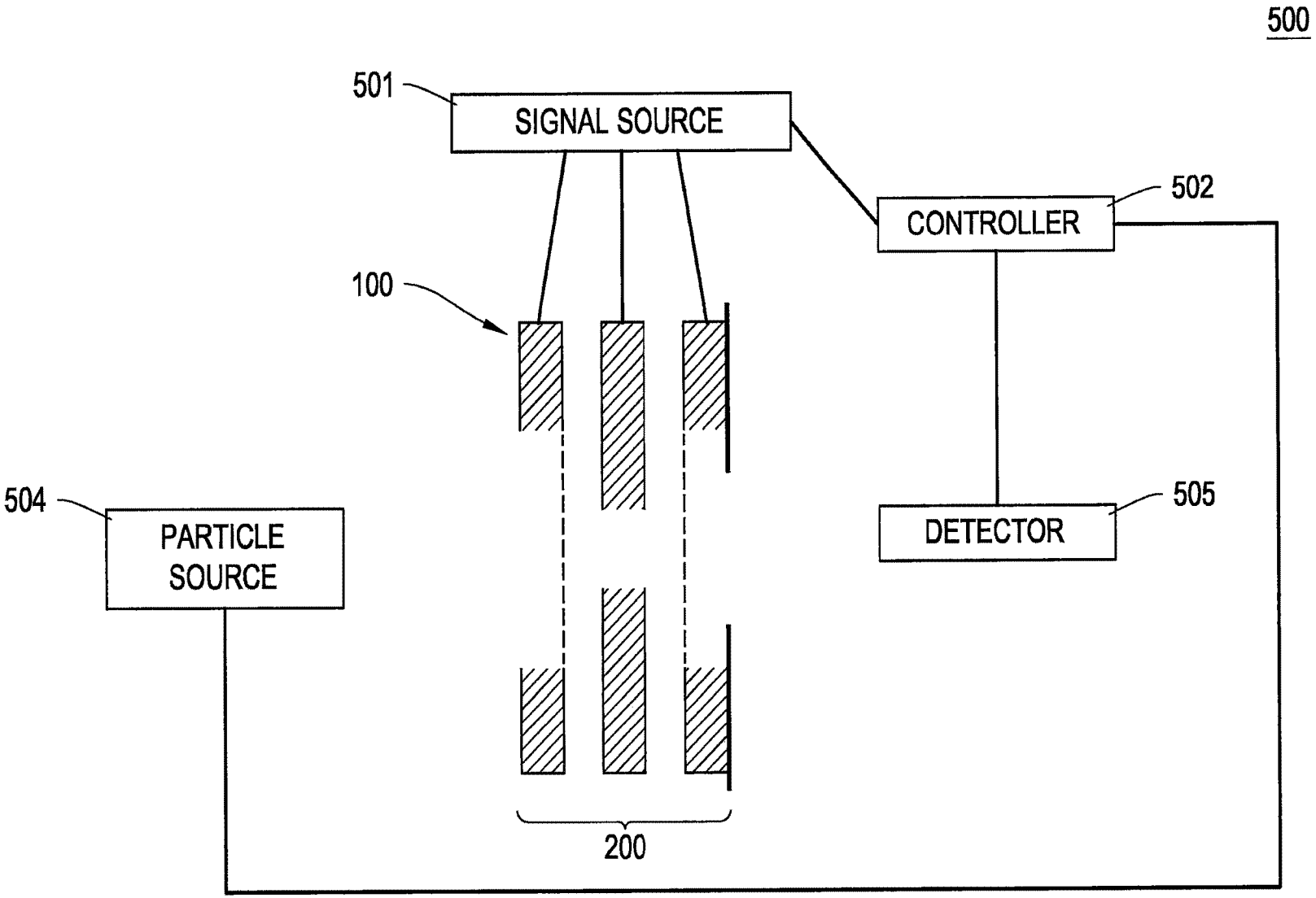
FIG. 5A is a schematic diagram of a mass spectrometry apparatus.

FIG. 5A is a schematic diagram of a mass spectrometry apparatus 500. The mass spectrometry apparatus 500 includes a trap 200 with a miniature electrode apparatus 100 for trapping charged particles, e.g., of the type described above with reference to FIGS. 1A-2C. An electrical signal source 501 is coupled to the ion trap assembly to deliver an electrical signal. The electrode apparatus 100 produces an electromagnetic field in response to signals. The electromagnetic field includes an ion trapping region located within transverse cavity formed by the electrodes. For example, in some embodiments, the signal source operates as a power supply coupled to the electrodes to provide an oscillating field between the central electrode and the end cap electrodes. In some embodiments the field oscillates at RF frequencies, e.g., in the range of a 1 MHz to 1000 GHz or any subrange thereof. Note that for operation at high pressure, high frequencies are desirable, such that the period of one oscillation of the trapping filed is much shorter that the average time for a trapped particle to collide with a particle in the background gas.

A controller 502 is operatively coupled to the electrical signal source 501 and configured to modulate the signal source to provide mass selective ejection of ions from the trapping region. In various embodiments, any suitable technique for achieving mass selective ejection may be used. For example, in some embodiments, RF potential applied to the trap 200 is ramped so that the orbit of ions with a mass a>b are stable while ions with mass b become unstable and are ejected on the longitudinal axis (e.g., through one of the end cap electrodes) onto a detector 503 (detailed below). In other embodiment, other techniques may be used, including applying a secondary axial RF signal across the endcap electrodes so as to create a dipolar electric field within the traps. This dipolar field can eject ions when their secular frequency becomes equal to the axial RF frequency.

The system 500 includes an ion source 504 configured to inject or form ions to be trapped in the trapping region. In various embodiments any suitable source may be used. For example, in some embodiments an electron source is used to direct electrons into the trap 200 (e.g., through one of the end cap electrodes). These electrons can ionize analyte species in the transverse cavity of the trap 200, forming ions, which are in turn trapped within the electrode structure. The ion source 505 may be operatively coupled to the controller, e.g., to turn the source on and off as desired during operation.

The system 500 also includes a detector 505 configured to detect charged particles (e.g., ions) ejected from the trap 200. In various embodiments, any suitable detector may be used. For high pressure applications, it may be advantageous to use a detector capable of operation at high background pressure, e.g., a Faraday cup type detector. For lower pressure applications, other types of detectors may be used, e.g., an electron multiplier detector. The detector may be operatively couple to the controller 502, e.g., to transmit a signal to the controller and processed to generate a mass spectrum.

The system 500 may include a chamber (not shown) containing the ion trapping assembly. The chamber may be maintained at a selected background pressure. In some embodiments, the background pressure is greater than 5 mtorr, 10 mtorr, 100 mtorr, 1 torr, 10 torr, 100 torr, 500 torr, or 760 torr. For example, in some embodiments the background pressure is in the range of 100 mtorr to 1000 mtorr or any subrange thereof.

In some embodiments, the system 500 may include an ion trap 200 featuring more that one trapping cavity, as described above. In some such cases, mass ejection from each of the cavities may be detected by a single detector 505, to produce a combined enhanced mass spectrum signal. For example, in some embodiments, the signal may be generated based on the combined output from at least 2, 5, 10, 15, 20, 25, 50, or 100 traps or more.

In some embodiments, mass ejection from each of (or a subset of) the multiple cavities may be detected by separate dedicated detectors 505. This arrangement may be useful in cases where each cavity (or subset of cavities) have differing trapping properties. For example, in some cases, an arrangement of this type may extend the range of ion masses that can be analyzed by the system 500.

In some embodiments featuring an elongated trapping region, ions may be preferentially ejected from a localized portion of the trapping region (e.g., an end portion, or a central portion).

Accordingly, in some embodiments, one may form or inject ions at a plurality of locations in trapping region and eject ions from substantially a single location in the trapping region. In some embodiments, one may form or inject ions in a first portion of the trapping region and eject ions from a second portion of the trapping region having a volume that is smaller than that of the first portion.

In some cases, spatially localized ejection may be advantageous. For example, in some embodiments, the resolution of the acquired mass spectrum may be improved. Not wishing to be bound by theory, in some embodiments it is anticipated that this improved resolution is related to the relatively small variation in electrode alignment in the localized region.

In some embodiments, e.g., where ions are preferentially ejected from localized regions, one may place one or more mask elements to block ions ejected from selected regions of the trap (e.g., regions other than the localized ejection region) from reaching the detector 505. In some embodiments, this may improve the resolution of the detected mass spectrum.

For example, as described above (e.g., in Reference to FIG. 4), in some embodiments, the trapping region may include a serpentine region extending between a pair of endpoints with a plurality of substantially straight portions and a plurality of curved portions connecting pairs of the substantially straight portions. In some such cases, it may be advantageous to block ions ejected from the curved portions and/or endpoints while allowing ions ejected from the straight portions to reach the detector 505. In other embodiments, the inverse arrangement may be used, where one blocks ions ejected from the straight portions while allowing ions ejected from the curved portions and/or endpoints to reach the detector 505.

In various embodiments, the system 500 may be implemented as a portable unit, e.g., a hand held unit. The system 500 may be used to obtain mass spectra from any suitable analyte including, for example, inorganic compounds, organic compounds, explosives, environmental contaminates, and hazardous materials.

In some embodiments, the system 500 may be implemented as a monitoring unit to be positioned within a selected area to monitor for a selected condition (e.g., the presence or level of one or more selected target materials). In some embodiments, the system 500 may include a data transmission device (e.g., a wired or wireless communication device) that can be used to communicate the detection of the selected condition.

Figure 5B:
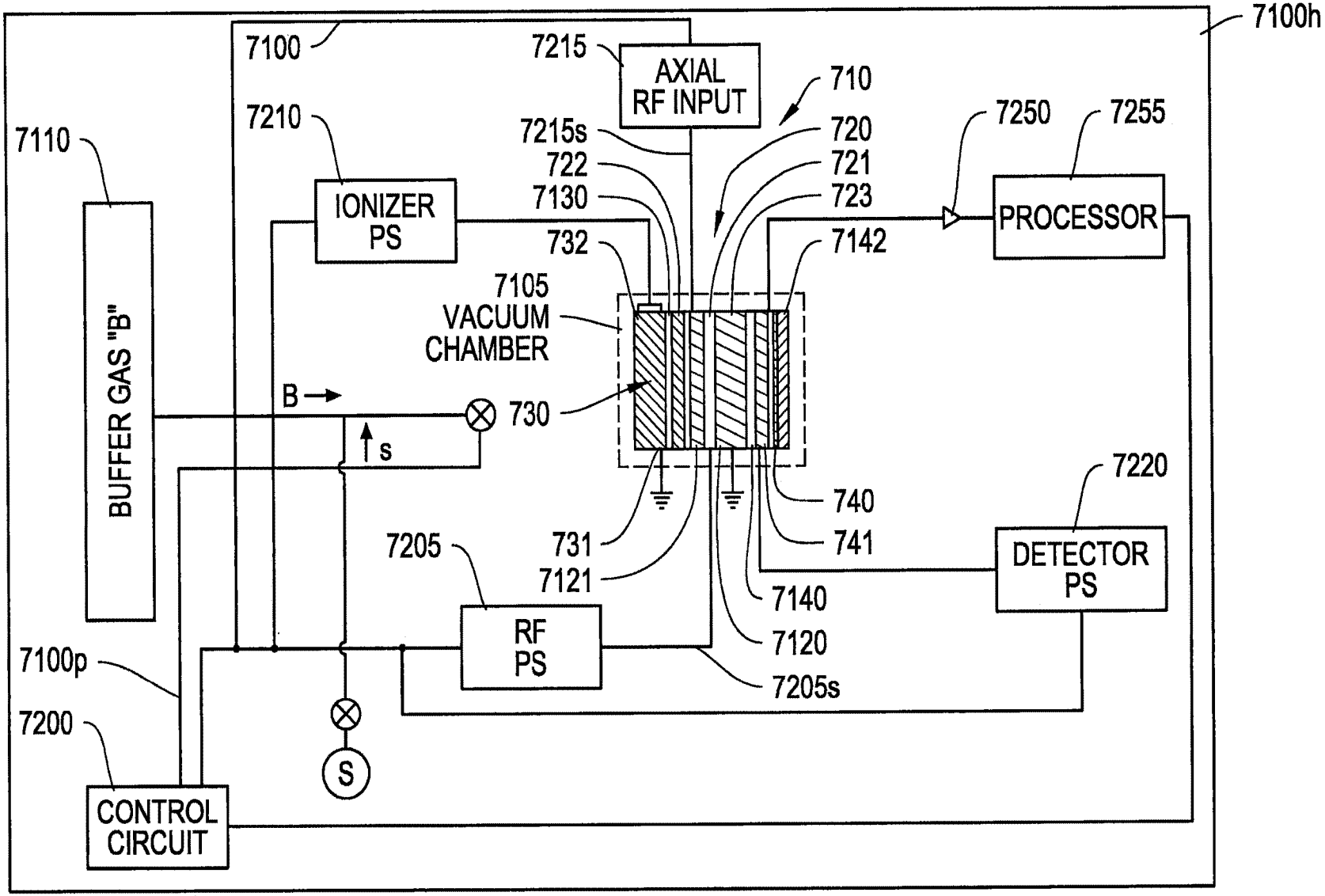
FIG. 5B is detailed functional diagram of a mass spectrometry apparatus.

FIG. 5B illustrates a mass spectrometry system 7100 (e.g. a portable system), a with a housing 7100*h* that encloses a mass spectrometry assembly 710, typically inside a vacuum chamber 7105 (shown by the broken line around the assembly 710). The housing 7100*h* can releasably attach a canister 7110 (or other source) of pressurized buffer gas "B" that connects to a flow path into the vacuum chamber 7105. The housing 7100*h* can hold a control circuit 7200 and various power supplies 7205, 7210, 7215, 7220 that connect to conductors to carry out the ionization, mass analysis and detection. The housing 7100*h* can hold one or more amplifiers including an output amplifier 7250 that connects to a processor 7255 for generating the mass spectra output. The system 7100 can be portable and lightweight, typically between about 1-15 pounds (not including a vacuum pump) inclusive of the buffer gas supply 7110, where used. The housing 7100*h* can be configured as a handheld housing, such as a game controller, notebook, or smart phone and may optionally have a pistol grip 7100*g* that holds the control circuit 7200. However, other configurations of the housing may be used as well as other arrangements of the control circuit. The housing 7100*h* holds a display screen and can have a User Interface such as a Graphic User Interface.

The system 7100 may also be configured to communicate with a smartphone or other pervasive computing device to transfer data or for control of operation, e.g., with a secure APP or other wireless programmable communication protocol.

The system 7100 can be configured to operate at pressures at or greater than about 100 mTorr up to atmospheric.

In some embodiments, the mass spectrometer 7100 is configured so that the ion source (ionizer) 730, ion trop mass analyzer 720 (of any of the types described herein) and detector 740 operate at near isobaric conditions and at a pressure that is greater than 100 mTorr. The term "near isobaric conditions" include those in which the pressure between any two adjacent chambers differs by no more than a factor of 100, but typically no more than a factor of 10.

Figure 5C:
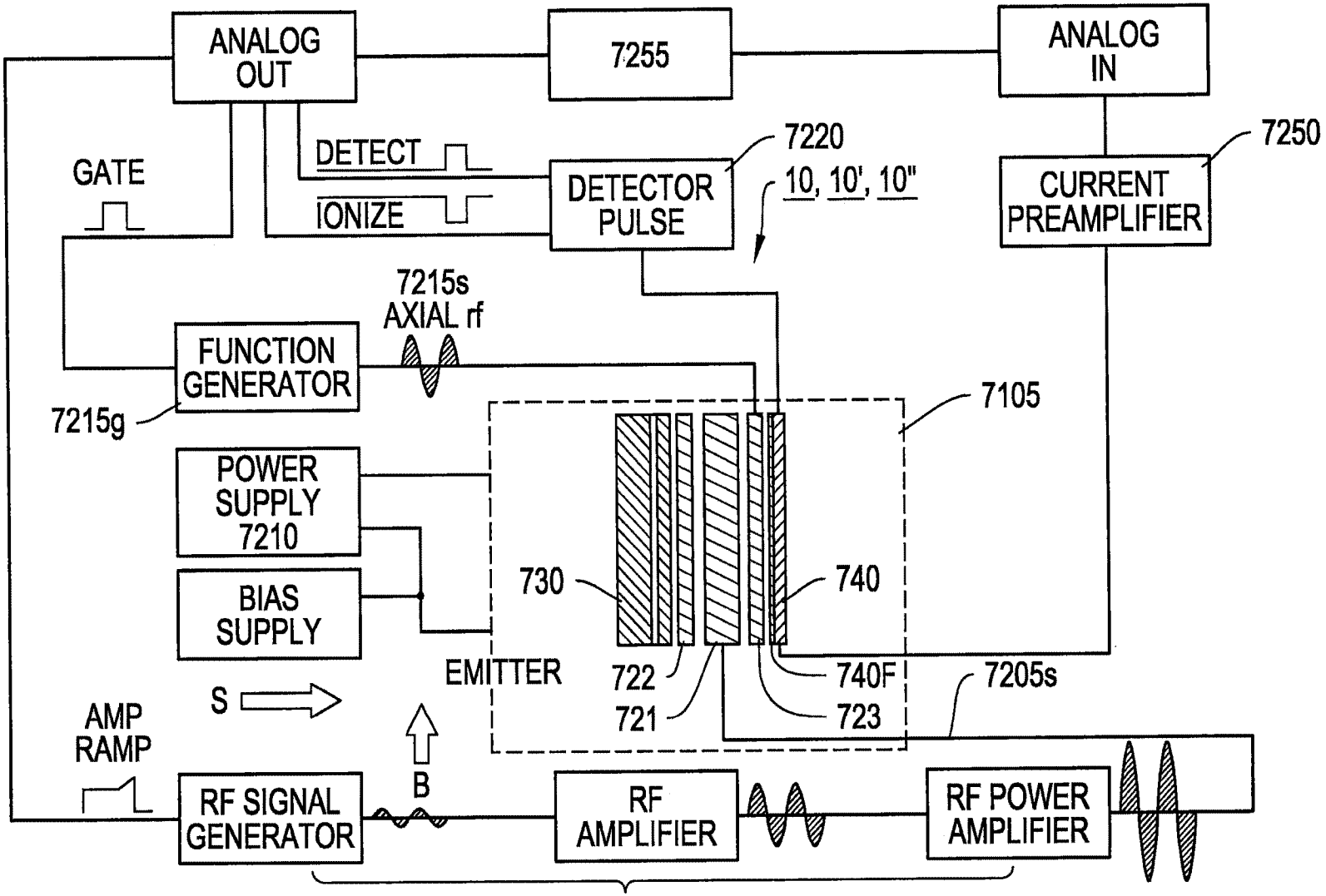
FIG. 5C is detailed functional diagram of a mass spectrometry apparatus.

As shown in FIG. 5C, the spectrometer 100 can include the mass spectrometry assembly 710 and an arbitrary function generator 215*g* to provide a low voltage axial RF input 215 to the ion trap 720 during mass scan for resonance ejection. The low voltage axial RF can be between about 100 mVpp to about 8000 mVpp, typically between 200 to 2000 mVpp. The axial RF 215*s* can be applied to an endcap 722 or 823, typically end cap 723, or between the two endcaps 722 and 723 during a mass scan for facilitating resonance ejection.

As shown in FIGS. 5B and 5C, the device 7100 includes an RF power source 7205 that provides an input signal to the central electrode 721 of the ion trap 720. The RF source 7205 can include an RF signal generator, RF amplifier and RF power amplifier. Each of these components can be held on a circuit board in the housing 7100*h* enclosing the ion trap 720 in the vacuum chamber 7105. In some embodiments, an amplitude ramp waveform can be provided as an input to the RF signal generator to modulate the RF amplitude. The low voltage RF can be amplified by a RF preamplifier then a power amplifier to produce a desired RF signal. The RF signal can be between about 1 MHz to 1000 MHz depending on the size of the ring electrode features. As is well known to those trained in the art, the RF frequency may depend on the size of the aperture in the central electrode. A typical RF frequency for a slit shaped aperture of the type shown in FIGS. 1A-15 with a dimension $x_o$ 500 μm would be 5-20 MHz. The voltages can be between 100 $V_{0p}$ to about 1500 $V_{0p}$, typically up to about 500 $V_{0p}$.

Generally stated, electrons are generated in a well-known manner by source 30 and are directed towards the mass analyzer (e.g., ion trap) 720 by an accelerating potential. Electrons ionize sample gas S in the mass analyzer 720. For ion trap configurations, RF trapping and ejecting circuitry is coupled to the mass analyzer 720 to create alternating electric fields within ion trap 720 to first trap and then eject ions in a manner proportional to the mass to charge ratio of the ions. The ion detector 40 registers the number of ions emitted at different time intervals that correspond to particular ion masses to perform mass spectrometric chemical analysis. The ion trap dynamically traps ions from a measurement sample using a dynamic electric field generated by an RF drive signal 7205*s*. The ions are selectively ejected corresponding to their mass-charge ratio (mass (m)/charge (z)) by changing the characteristics of the radio frequency (RF) electric field (e.g., amplitude, frequency, etc.) that is trapping them. These ion numbers can be digitized for analysis and can be displayed as spectra on an onboard and/or remote processor 7255.

In the simplest form, a signal of constant RF frequency 205*s* can be applied to the center electrode 21 relative to the two end cap electrodes 22, 23. The amplitude of the center electrode signal 205*s* can be ramped up linearly in order to selectively destabilize different m/z of ions held within the ion trap. This amplitude ejection configuration may not result in optimal performance or resolution. However, this amplitude ejection method may be improved upon by applying a second signal 215*s* differentially across the end caps 22, 23. This axial RF signal 215*s*, where used, causes a dipole axial excitation that can result in the resonant ejection of ions from the ion trap when the ions' secular frequency of oscillation within the trap matches the end cap excitation frequency.

The ion trap 720 or mass filter can have an equivalent circuit that appears as a nearly pure capacitance. The amplitude of the voltage 7205*s* to drive the ion trap 720 may be high (e.g., 100 V-1500 Volts) and can employ a transformer coupling to generate the high voltage. The inductance of the transformer secondary and the capacitance of the ion trap can form a parallel tank circuit. Driving this circuit at resonant frequency may be desired to avoid unnecessary losses and/or an increase in circuit size.

The vacuum chamber 7105 can be in fluid communication with at least one pump (not shown). The pumps can be any suitable pump such as a roughing pump and/or a turbo pump including one or both a TPS Bench compact pumping system or a TPS compact pumping system from Varian (now Agilent Technologies). The pump can be in fluid communication with the vacuum chamber 105. In some embodiments, the vacuum chamber can have a high pressure during operation, e.g., a pressure greater than 100 mTorr up to atmospheric. High pressure operation allow elimination of high-vacuum pumps such as turbo molecular pumps, diffusion pumps or ion pumps. Operational pressures above approximately 100 mTorr can be easily achieved by mechanical displacement pumps such as rotary vane pumps, reciprocating piston pumps, or scroll pumps.

Sample S may be introduced into the vacuum chamber 7105 with a buffer gas B through an input port toward the ion trap 720. The S intake from the environment into the housing 100*h* can be at any suitable location (shown by way of example only from the bottom). One or more Sample intake ports can be used.

The buffer gas B can be provided as a pressurized canister 7110 of buffer gas as the source. However, any suitable buffer gas or buffer gas mixture including air, helium, hydrogen, or other gas can be used. Where air is used, it can be pulled from atmosphere and no pressurized canister or other source is required. Typically, the buffer gas comprises helium, typically above about 90% helium in suitable purity (e.g., 99% or above). A mass flow controller (MFC) can be used to control the flow of pressurized buffer gas B from pressurized buffer gas source 110 with the sample S into the chamber 105. When using ambient air as the buffer gas, a controlled leak can be used to inject air buffer gas and environmental sample into the vacuum chamber. The controlled leak design would depend on the performance of the pump utilized and the operating pressure desired.

FIG. 9D illustrates an exemplary timing diagram that can be used to carry out/control various components of the mass spectrometer 7100. The drive RF amplitude signal can be driven using a ramp waveform that modulates the RF amplitude throughout the mass scan and the other three pulses control ionization, detection and axial RF voltages applied. As shown, initially, 0 V can optionally be applied to the gate lens 750 (where used) to allow electrons to pass through during the ionization period. Alternatively, this signal can be applied to the ionizer 30 directly to turn on and off the production of electrons or ions. The drive RF amplitude 7205*s* can be held at a fixed voltage during an ionization period to trap ions generated inside the trap 720. At the end of the ionization period, the gate lens voltage (if used) is driven to a potential to block the electron beam of the ionizer 730 and stop ionization. The drive RF amplitude 205*s* can then be held constant for a defined time, e.g., about 5 ms, to allow trapped ions to collisionally cool towards the center of the trap. The drive RF amplitude 7205*s* can be linearly ramped to perform a mass instability scan and eject ions toward the detector 40 in order of increasing m/z. The axial RF signal 7215*s* can be synched to be applied with the start of ramp up of the RF amplitude signal linear ramp up (shown at t=6 ms, but other times may be used) so as to be substantially simultaneously gated on to perform resonance ejection during the mass scan for improved resolution and mass range. Data is acquired during the mass instability scan to produce a mass spectrum. Finally, the drive RF amplitude 7205*s* can be reduced to a low voltage to clear any remaining ions from the trap 720 and prepare it for the next scan. A number of ion manipulation strategies can be applied to ion trap devices such as CITs, as is well known to those trained in the art. All of the different strategies to eject, isolate, or collisionally dissociate ions can be applied to the ion trapping structures discussed in the application.

In various embodiments, devices described herein may be used to implement any mass spectrometry technique know in the art, including tandem mass spectrometry (e.g., as described in U.S. Pat. No. 7,847,240. The devices described herein may be used in other applications, e.g., trapping of charged particles for purposes such as quantum computing, precision time or frequency standards, or any other suitable purpose.

EXAMPLES

Stretched Length Ion Trap Electrodes

The following examples describe the use of SLIT type traps for obtaining mass spectra. For comparison, in some cases spectra were also obtained using traps featuring a central electrode having a cylindrically symmetrical trapping aperture, of the type described in U.S. Pat. No. 6,469,298 issued Oct. 22, 2002. This Cylindrical Ion Trap type will be referred to in the following as a "CIT."

The SLIT and CIT traps were constructed using the following techniques. An 800-μm thick copper sheet stock for the middle electrode and an 250-μm thick beryllium copper sheet stock for the endcap electrodes were photolithographically patterned and wet chemically etched to the basic shape shown in FIG. 1A (Towne Technologies, Somerville N.J.). The middle electrode void was conventionally machined with a 1-mm endmill. The CIT was made with no additional length added yielding a cylindrical aperture with radius $r_o$=0 5 mm while the SLIT features were machined with $y_o$ dimensions ranging from 2 mm to 6 mm. The endcap support electrodes were drilled out to a diameter of 5 mm before 100 lines per inch (LPI), 73% transmission electroformed copper mesh was bonded across the opening (Precision Electroforming, Cortland N.Y.). A spacing of 250 μm between endcap and center electrodes was achieved with kapton washers yielding a trap with critical dimensions of $z_O$=650 μm, $x_O$=500 μm. In this example, $z_O$ is defined to be the sum of the half thickness of the center electrode and the spacing between the center electrode and endcap, and $x_O$ is one-half the width of the narrow dimension of the SLIT void. Other $z_O/x_O$ ratios were also explored by milling SLIT's with widths ranging from 0.94 mm to 1.17 mm and observing changes in the resolution of mass spectra where the stable isotopes of Xe were used as a sample.

Instrument Design and Operation

Figure 5D:
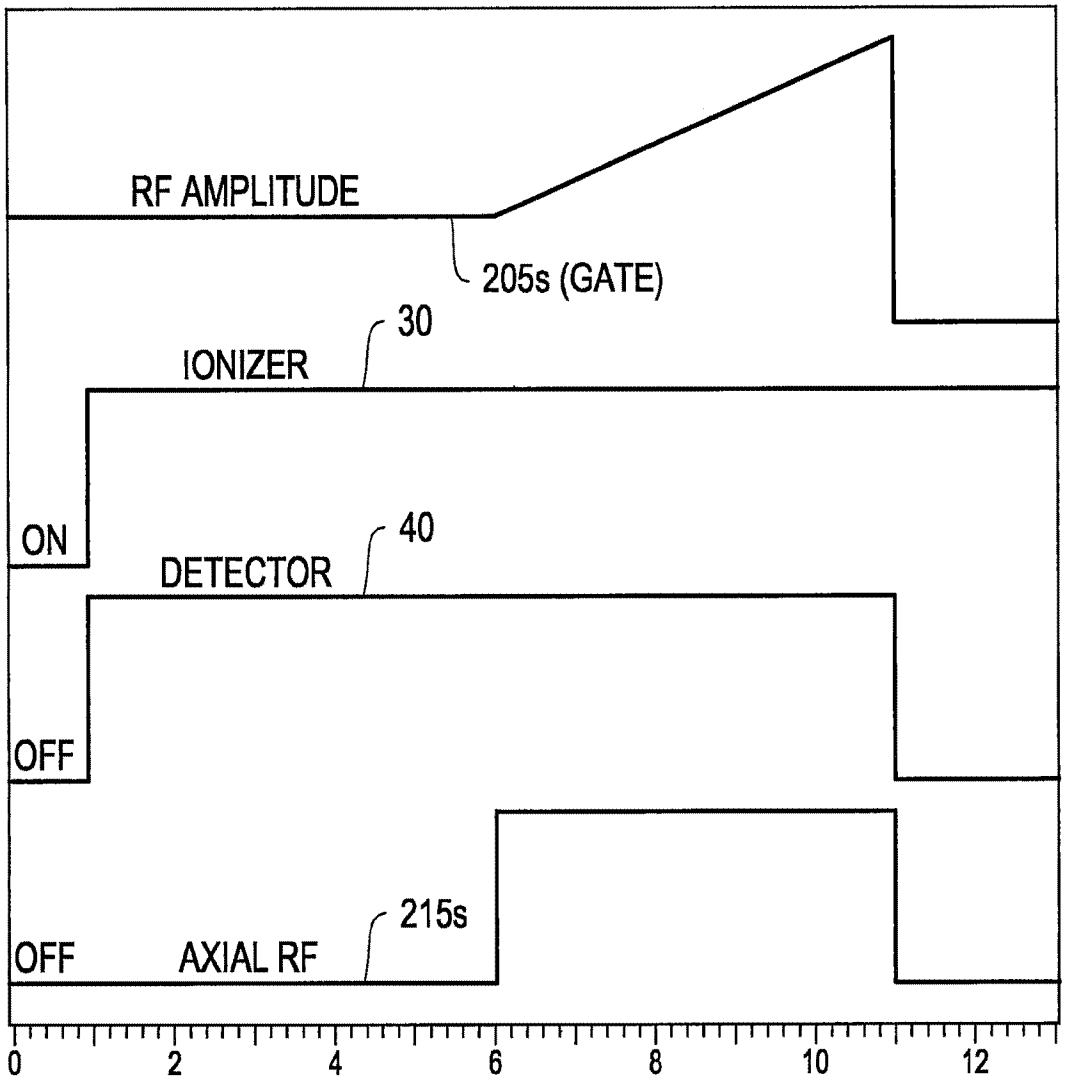
FIG. 5D an exemplary timing diagram of a mass spectrometry system
Figure 6:
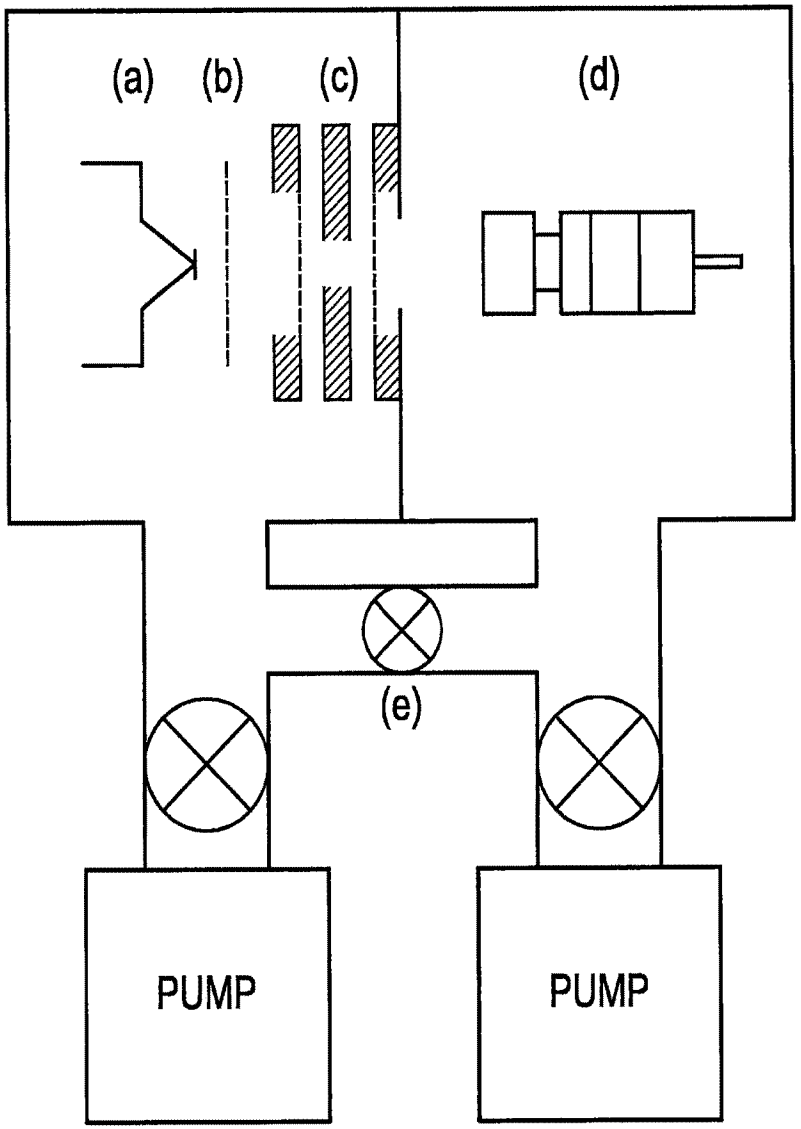
FIG. 6 is a schematic diagram for a mass spectrometry apparatus featuring a differentially pumped chamber.
Figure 7:
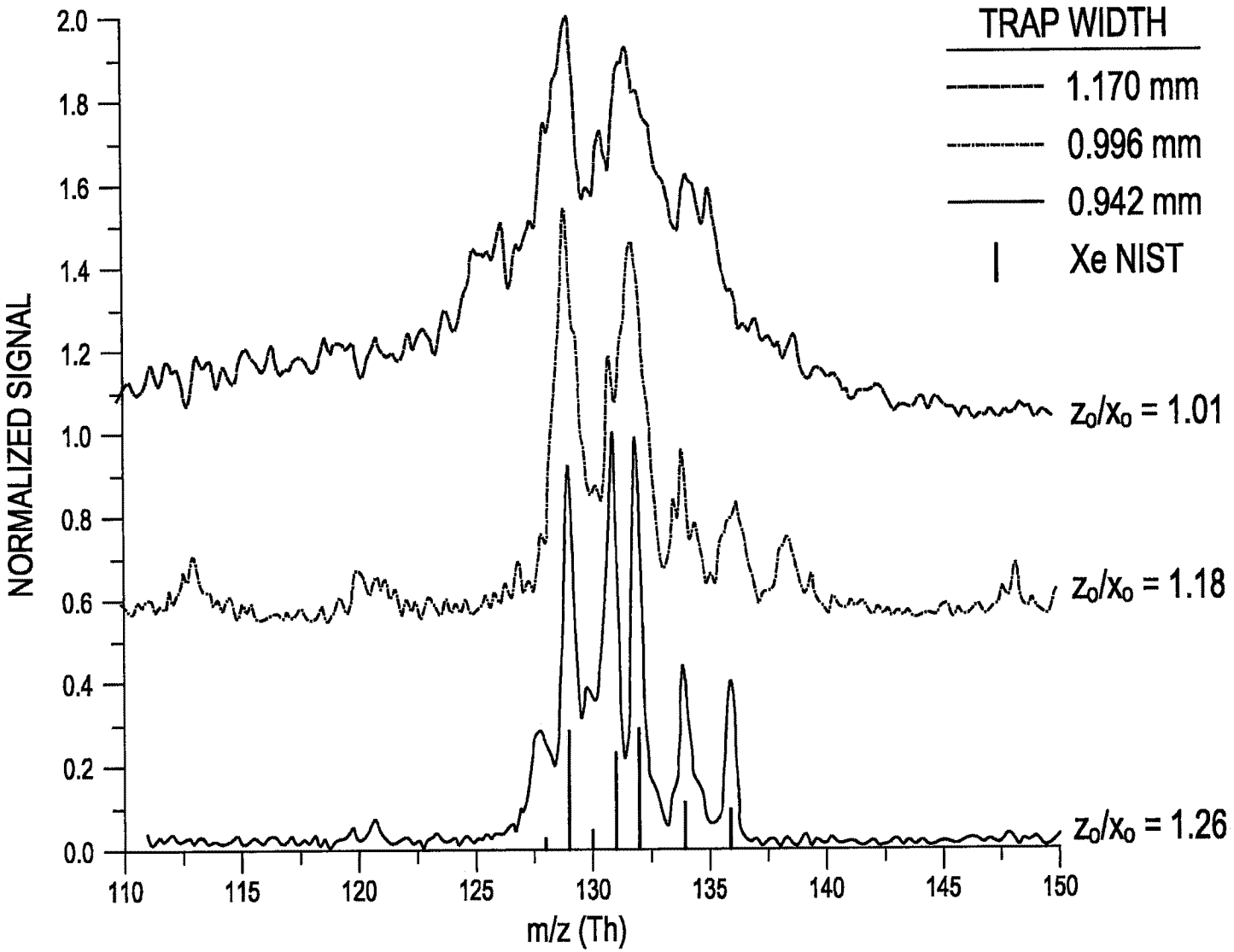
FIG. 7 shows mass spectra of $10^{-4}$ torr Xe in 30 mtorr helium buffer gas obtained using Stretched Length Ion Traps (SLITs) with varying trap widths showing the change in resolution as the trap width is varied.

The SLIT electrode assemblies were placed inside a custom instrument featuring a mass spectrometry arrangement of the type shown and described with reference to FIGS. 5B-5D, modified to include a dual chamber design suitable for use with detectors operating at high or low background pressure. A simplified instrumental configuration is shown in FIG. 6 which includes a custom aluminum dual chamber design for differential pressure operation with the trapping electrodes acting as the conductance limit.

Gaseous samples of mesitylene (Sigma Aldrich) and a 10% Xe/90% He mixture (Air Liquide, 99.999% purity) were introduced via a precision leak valves (ULV-150, MDC Vacuum Products) and measured with a full range vacuum gauge (FRG-700, Varian) and reported as uncorrected values. Helium or nitrogen buffer gas was admitted through a 100 sccm mass flow controller (Omega FMA5408) and the absolute pressure measured with a 2 torr full scale capacitance manometer with 0.12% accuracy (MKS 627D). Instrument operation was conducted in a typical in-trap electron ionization scheme. A yttria-coated iridium disk emitter (ES-525, Kimball Physics) was used in conjunction with an 80 LPI stainless steel mesh gate electrode in order to illuminate the trapping area with electrons. All experiments utilized a 6.4 MHz trapping RF frequency and non-linear resonant ejection about the ⅓ hexapolar resonance with an axial RF of 2.23 MHz applied to the front endcap while keeping the back endcap grounded to the chamber, however, slight variations in the resonant axial RF frequency were observed for each individual trap. Mass selectively ejected ions were detected by a variety of methods. For low-pressure operation, below 100 mtorr, ions were detected with an electron multiplier (2300, DeTech), and the resultant signal was amplified (SR570, Stanford Research Systems) and digitized via a 16 bit analog input card (PXI-6122, National Instruments). For comparison, experiments with the CIT were also performed using this experimental setup. For experiments using high pressure nitrogen as a buffer gas, a Faraday cup detector was used and consisted of a 12.5 mm diameter brass plate used to collect ions. A charge sensitive preamplifier (CoolFET A250CF, AmpTek) was used to convert the collected charge into a voltage suitable for monitoring with the analog input card. With the Faraday cup detector, both chambers were operated at the same pressure by opening a valve in between the two. For higher-pressure helium buffer gas experiments above 100 mtorr, an electron multiplier was again used. Several modifications were made due to the much higher gas conductance of the SLIT vs the CIT. To limit conductance between the two chambers a 5 mm by 0.2 mm slot was machined in a 0.250 mm thick electrode and placed behind the detector side endcap electrode. In addition, the DeTech electron multiplier was replaced with the more pressure tolerant MegaSpiraltron electron multiplier (Photonic, Sturbridge Mass.).

EXPERIMENTAL RESULTS

Alignment of the three electrodes for CIT's was found to be critically related to trap performance. The SLIT electrode structure adds another degree of freedom and more complex alignment if using solid endcap electrodes with slots for ion ejection. Fine electroformed copper mesh (as shown in FIG. 3) was used to simulate a planar endcap electrode, and thus removing three degrees of freedom from alignment, i.e., one rotational and two lateral degrees of freedom. For all experiments described only screw hole alignment was used for electrode assembly. The primary alignment tolerance of concern was the $z_O$ distance across the entire length of the trap. A variable $z_O$ value across the length of the trap would cause ion ejection to be dependent on its y-axis position, potentially leading to deterioration of spectral resolution.

In the absence of any dc component to the trapping field, the equations governing the trapping and ejection of ions in a two-dimensional quadrupolar field are identical to the three dimensional case. Consequently the optimum electrode spacings (250 μm) were thought to be identical to the previously determined optimal spacing for the CIT's. This was experimentally confirmed by observing the optimum spectral resolution among differing $z_O/x_O$ ratios. This particular $z_O/x_O$ ratio was determined to be optimal by milling SLIT's with widths ranging from 0.94 mm to 1.17 mm and observing the change in resolution of the resulting Xe spectra shown in FIG. 7. The value of the experimentally observed $z_0/x_0$ ratio that produced the best spectral resolution is 1.3 and corresponds to a stretched configuration similar to $z_0/r_0$ values observed for CITs, e.g., as described in U.S. Pat. No. 6,469,298 issued Oct. 22, 2002. This ratio was observed to be optimal for all values of $y_0$, the length of the SLIT stretch distance, investigated.

Figure 8A:
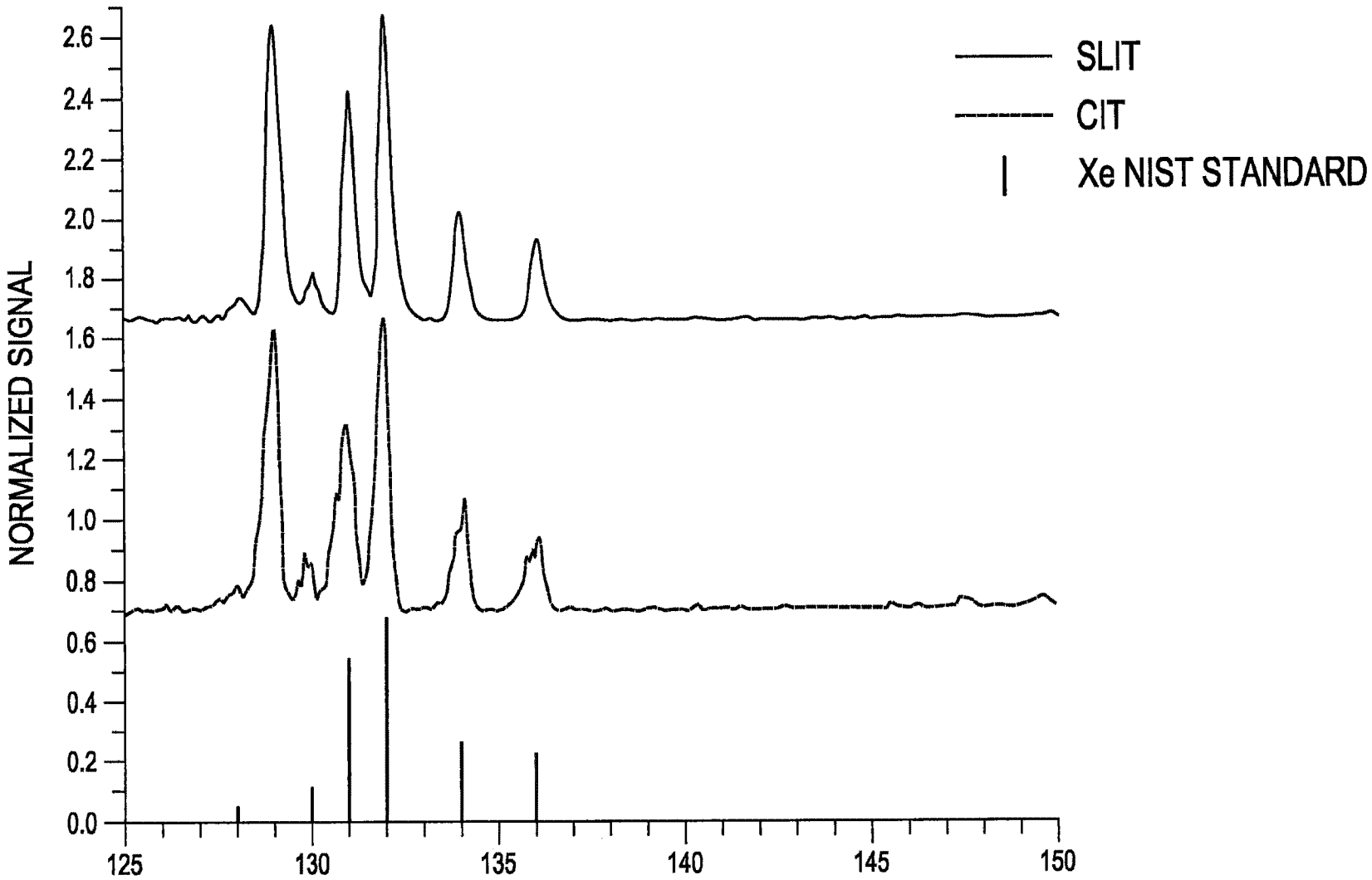
FIGS. 8A and 8B illustrate a comparison of SLIT and Cylindrical Ion Trap (CIT) performance.
Figure 8B:
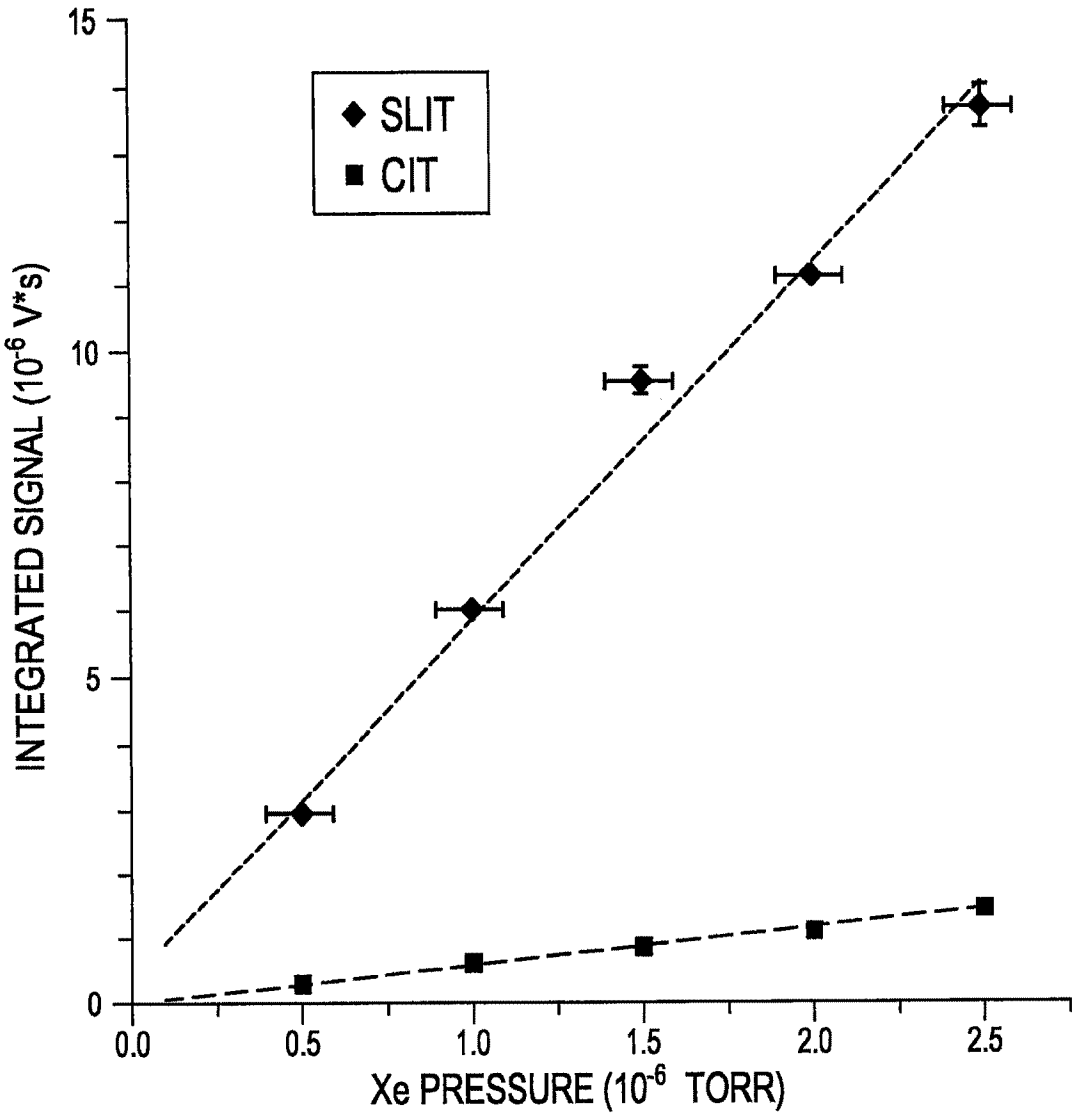
Figure 9:
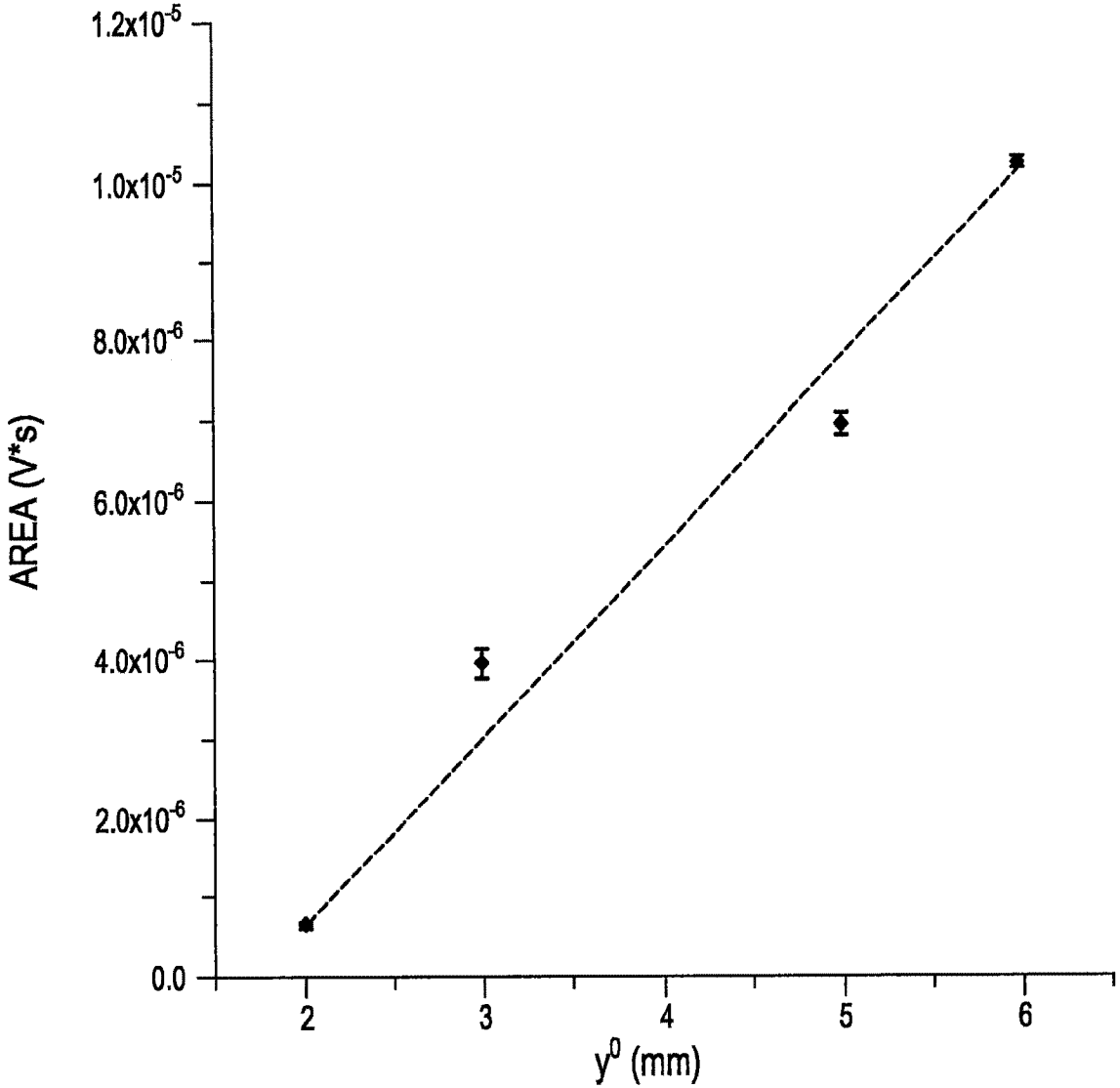
FIG. 9 shows a plot of SLIT signal as a function of trapping length extension. Individual spectra were of Xe at $10^{-4}$ torr in 33 mtorr He. Error bars represent the standard deviation of the spectra taken serially in triplicate.

Shown in FIG. 8A are representative xenon spectra directly comparing a SLIT and CIT with $x_O$ (SLIT)=$r_O$ (CIT) and identical electrode spacing. The 500 scan averages were taken of $1.0\times10^{-4}$ torr of the Xe/He mix taken at 50 mtorr He and both normalized to better compare the relative resolution. The average peak width at FWHM of the five major peaks in the Xe SLIT spectrum is 0.41 Th compared to 0.44 Th for the CIT. In general, for identical conditions, SLIT spectra were observed to have larger signal intensities than those obtained with a CIT while maintaining similar resolution. This increased sensitivity is quantified in FIG. 8B, where the changes in total integrated signal vs. the sample pressure for both the SLIT and CIT are plotted. The increase in trapping capacity inherent in trapping ions along a linear dimension rather than a point is clearly shown by the approximately 10× increase in sensitivity. Furthermore, it is expected that the total ion signal should be linearly related to the value of the SLIT $y_O$ parameter allowing one to design electrode structures to address sensitivity requirements. To test this hypothesis, several SLIT electrodes of different lengths, $y_O$ values, were machined with all other dimensions remaining equal. FIG. 9 shows the integrated ion current for Xe spectra as a function of the $y_o$ length. These data indeed show an approximately linear dependence of signal on trapping length suggesting that as the traps are made ever narrower in width, the relative gain in signal of the SLIT over the CIT will continue to increase, assuming a constant trap length, $y_O$.

Figure 10:
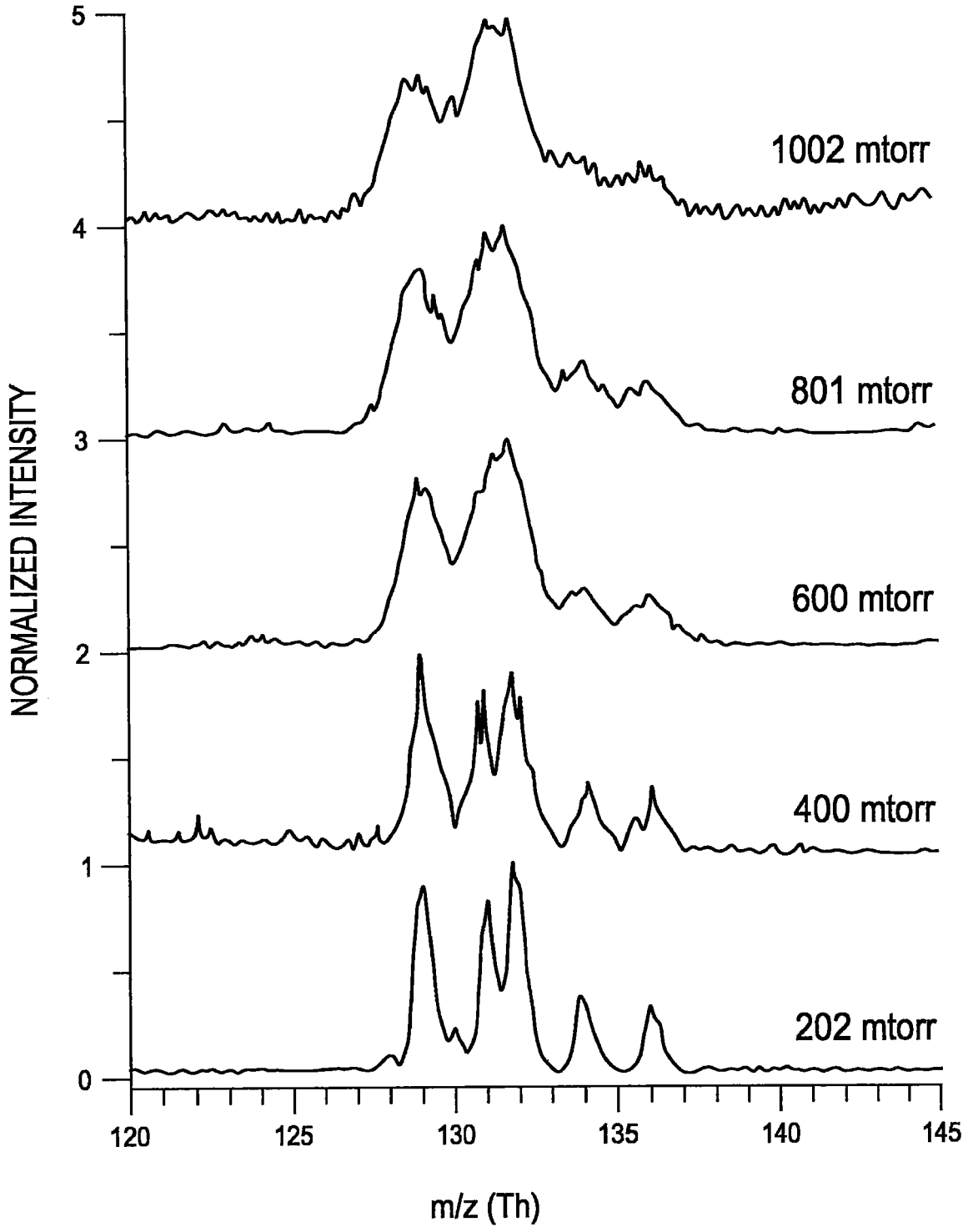
FIG. 10 shows Xe SLIT mass spectra taken with He buffer gas pressures from 202 to 1002 mtorr. Both resolution and signal deteriorate as pressure is increased. Signal loss is adjusted for by increasing the total amount of ionizing electrons by adjusting ionization time, emitter bias voltage, and emitter current. The approximately 0.5 Th peak width at low pressures deteriorates to an estimated 2 Th peak width at 1 torr.

CITs with 500 μm $r_O$ values have been demonstrated to produce mass spectra at pressures exceeding 1 Torr. Because SLITs function in a similar manner as the CIT, they were also expected to operate at higher pressures. SLIT mass spectra at He buffer gas pressures ranging from 0.2-1 torr are shown in FIG. 10. The experiments were performed by leaking in $1.3\times10^{-4}$ torr of the Xe/He mix under reduced pumping speeds and adjusting the He buffer flow rate from 1 to 70 sccm. The electron flux available for ionization decreases as the pressure increases due to increased cooling of the thermionic emitter and decreased mean free path for the electrons. We attempted to compensate for electron ionization losses versus pressure by increasing the emitter current, ionization time, and the emitter bias voltage relative to the trap with rising pressure. To further improve spectra at these high pressures, the axial RF amplitude was also increased with pressure. The experimental conditions for each spectrum in FIG. 10 are given in the table shown in FIG. 11. An analysis of the resolution shows peak broadening with higher pressures as expected as collisions with the buffer gas compete with the electric field for control of ion trajectories. In line with high pressure data in CIT's, the five major isotopic peaks are still resolved as high as 400-500 mtorr with an average peak width of 0.87 Th.

Figure 12:
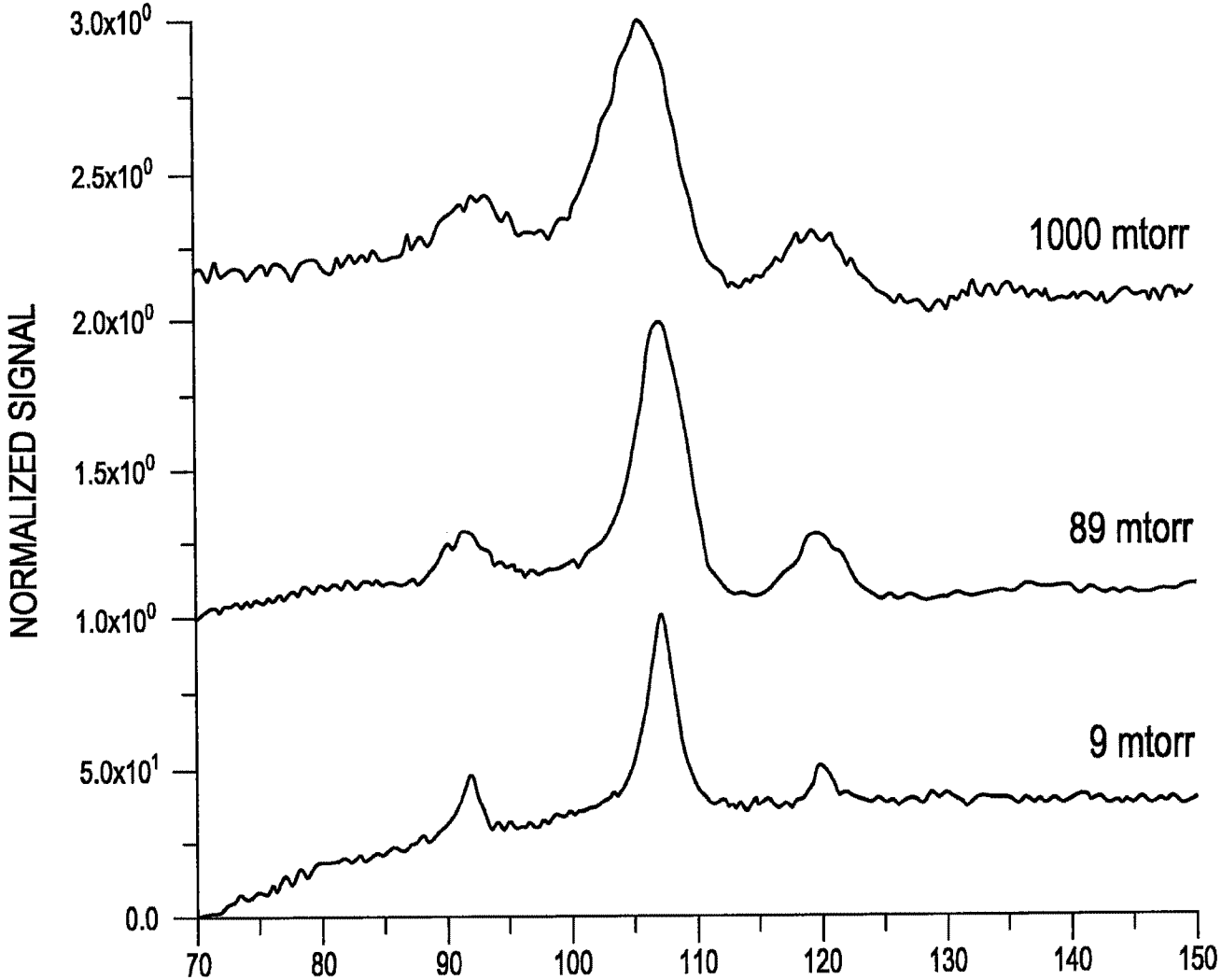
FIG. 12 shows SLIT obtained mass spectra of the organic compound mesitylene with nitrogen buffer gas at pressures from 9 mtorr to 1000 mtorr. Ionization conditions were adjusted as the pressure was raised to facilitate more ionizing electrons in the trap. The width of the major mesitylene peak grows from 2.3 Th to 7.2 Th over this pressure range.

We have demonstrated capturing spectra at high pressures but further adjustments in instrumental operation will eventually need to be made in order to create practical, highly portable mass spectrometers. One operational change would be the use of nitrogen or air as the buffer gas in place of helium. Both clean nitrogen and air can be generated at the point of use eliminating the need to carry a helium source. Another change would be to use a more pressure tolerant detector such as a faraday cup. It is thus useful to explore how the SLIT design performs while analyzing an organic sample with nitrogen as a buffer gas and using a pressure tolerant Faraday cup detector. Spectra of mesitylene collected at 9, 80, and 1000 mtorr in nitrogen buffer gas are shown in FIG. 12. Even at low pressure, the peak widths are wider than the He buffer gas spectra because of the greater momentum transfer associated with nitrogen molecule collisions. Again, the peak width increases significantly with pressure. Note that the irregular shape of the background is an artifact of how the CoolFET preamp for the detector is operated and could easily be accounted for in other experimental designs.

Figure 13B:
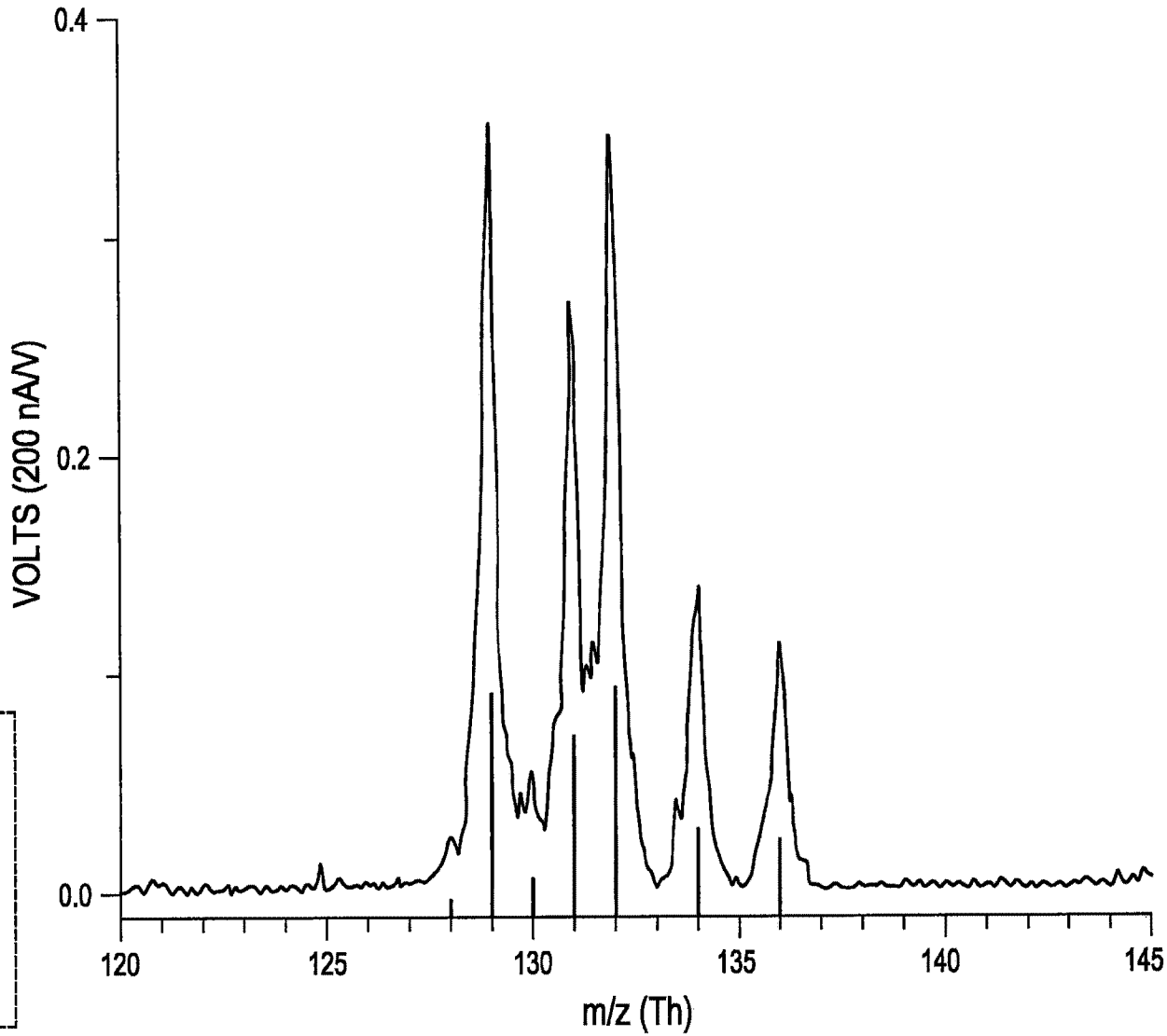
FIG. 13B shows a mass spectrum for $10^{-4}$ torr Xe in 30 mtorr He buffer gas obtained using a SLIT trap featuring the central electrode shown in FIG. 13A.
Figure 13A:
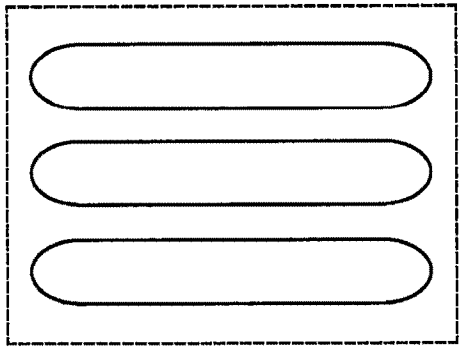
FIG. 13A shows a central electrode for a SLIT trap featuring three trapping cavities.

Forming parallel arrays of multiple SLIT's from one middle and two endcap electrodes may increase the number of ions trapped and thus the signal ultimately detected without any operational differences from a single trap device. For example, FIG. 13A shows a middle electrode of a three SLIT array. This was fabricated by machining 3 identical SLIT features 1-mm wide separated by 0.5 mm. The SLIT arrays utilizes the same electroformed mesh endcaps as outlined above. FIG. 13B shows a mass spectrum obtained using this configuration for Xenon in 30 mtorr He buffer. The data shows good signal. The moderate increase in peak width as compared with a single trap is attributed to slight differences in trap tolerances due to the precision of machining.

Figure 14A:
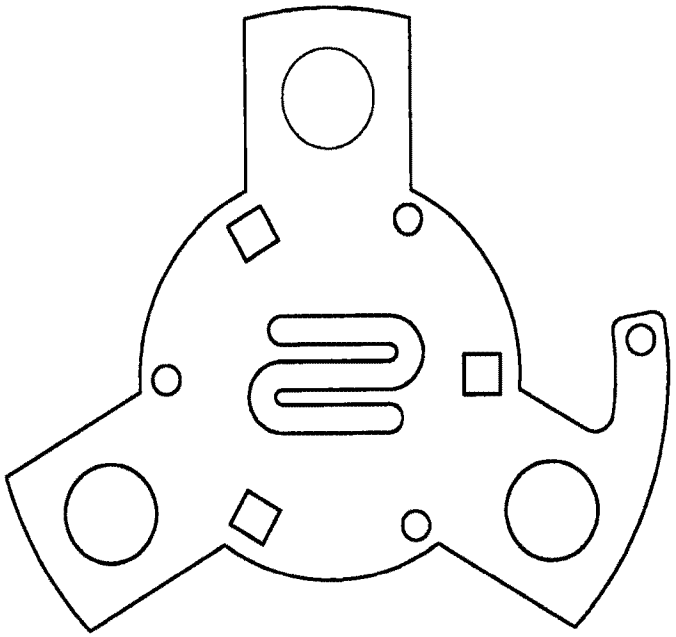
FIGS. 14A-14B illustrate experimental results demonstrating the trapping of ions along the full length of a serpenting slit trap.
Figure 14A:
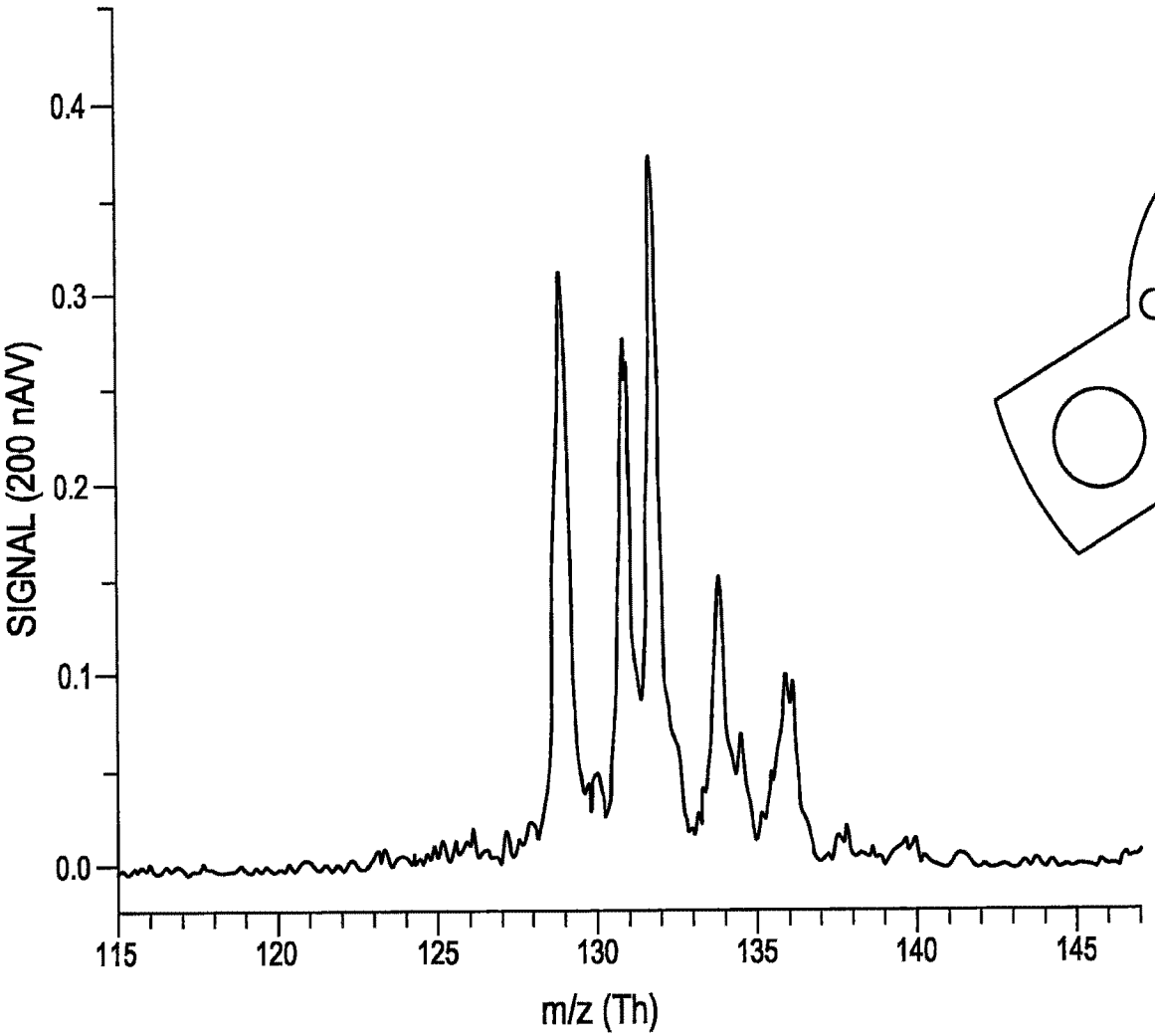

Referring to FIG. 14A, an experiment was performed where the central electrode for a SLIT was conventionally machined with a 1.0 mm endmill to include a serpentine aperture having 3 straight 4 mm sections connected by two curved sections. Each straight section is separated from one another by 0.5 mm width posts. The trap was constructed with the same endcap electrodes and spacers as the conventional SLIT described above and placed inside the chamber shown in FIG. 6. Mass spectroscopic analysis of $8.0\times10^{-5}$ torr of Xe in 30 mtorr He was performed and resulted in the spectrum shown. Adequate resolution and good signal intensity were seen.

Figure 14B:
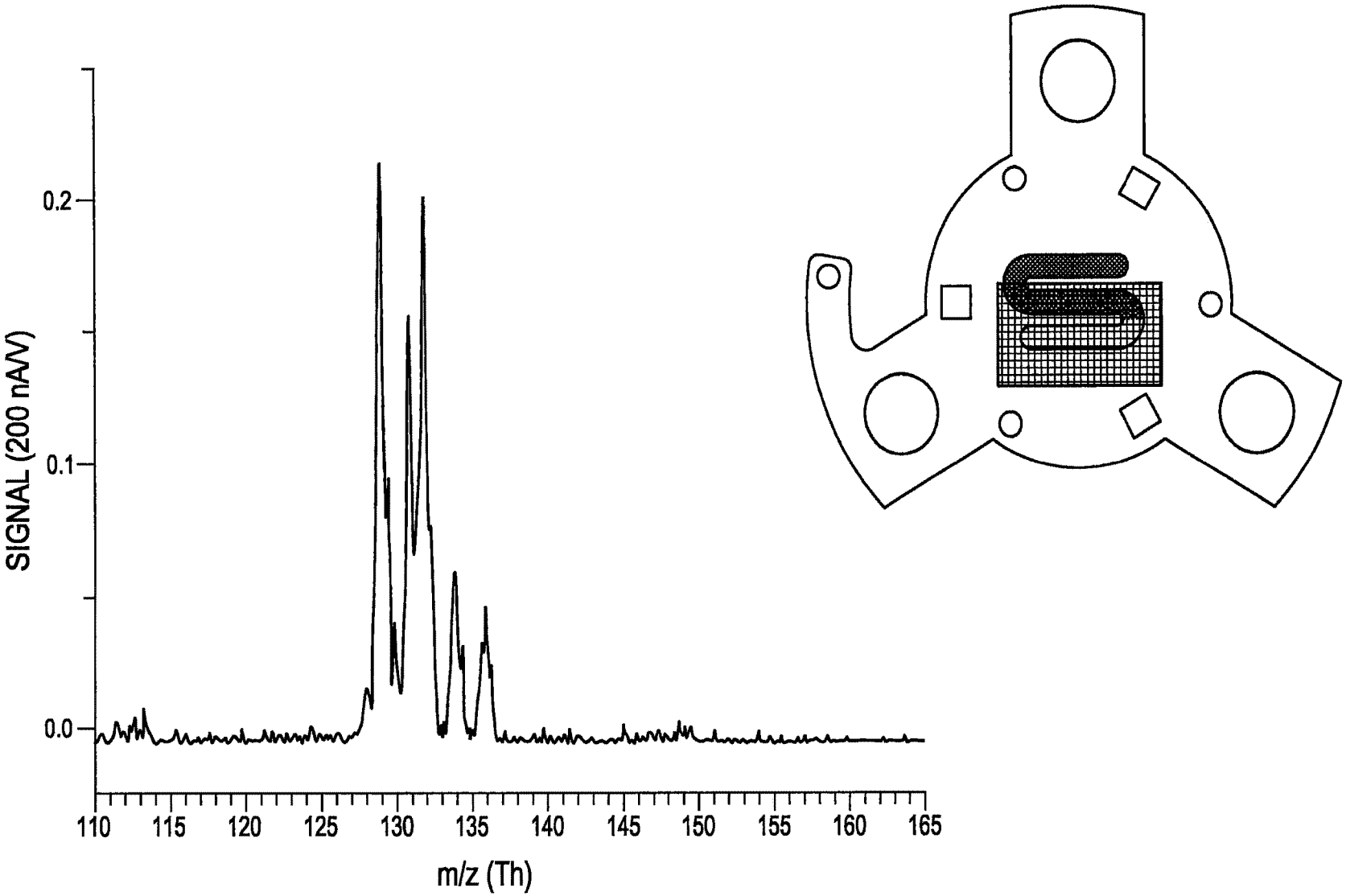

Referring to FIG. 14B, to observe ion travel throughout the entire length of the serpentine trap the following experiment was set up using the same electrode set shown in FIG. 14A. Additional charged particle masking elements were added to control ionization and ion ejection positions. A single copper masking element was placed over the ionization side endcap to allow for ionization only in the top third of the trapping volume. A second copper masking element was placed over the detector side endcap to block ion ejection from all but the bottom third of the trap. In this manner, the only way ion signal can be seen at the detector is for the ions to be formed in the top third of the serpentine SLIT structure and have at least a fraction of them migrate all the way to the bottom third before ejection. This was observed using $3.5\times10^{-5}$ torr Xe in 30 mtorr He buffer gas and a Xe spectrum is shown in FIG. 14B.

Figure 15:
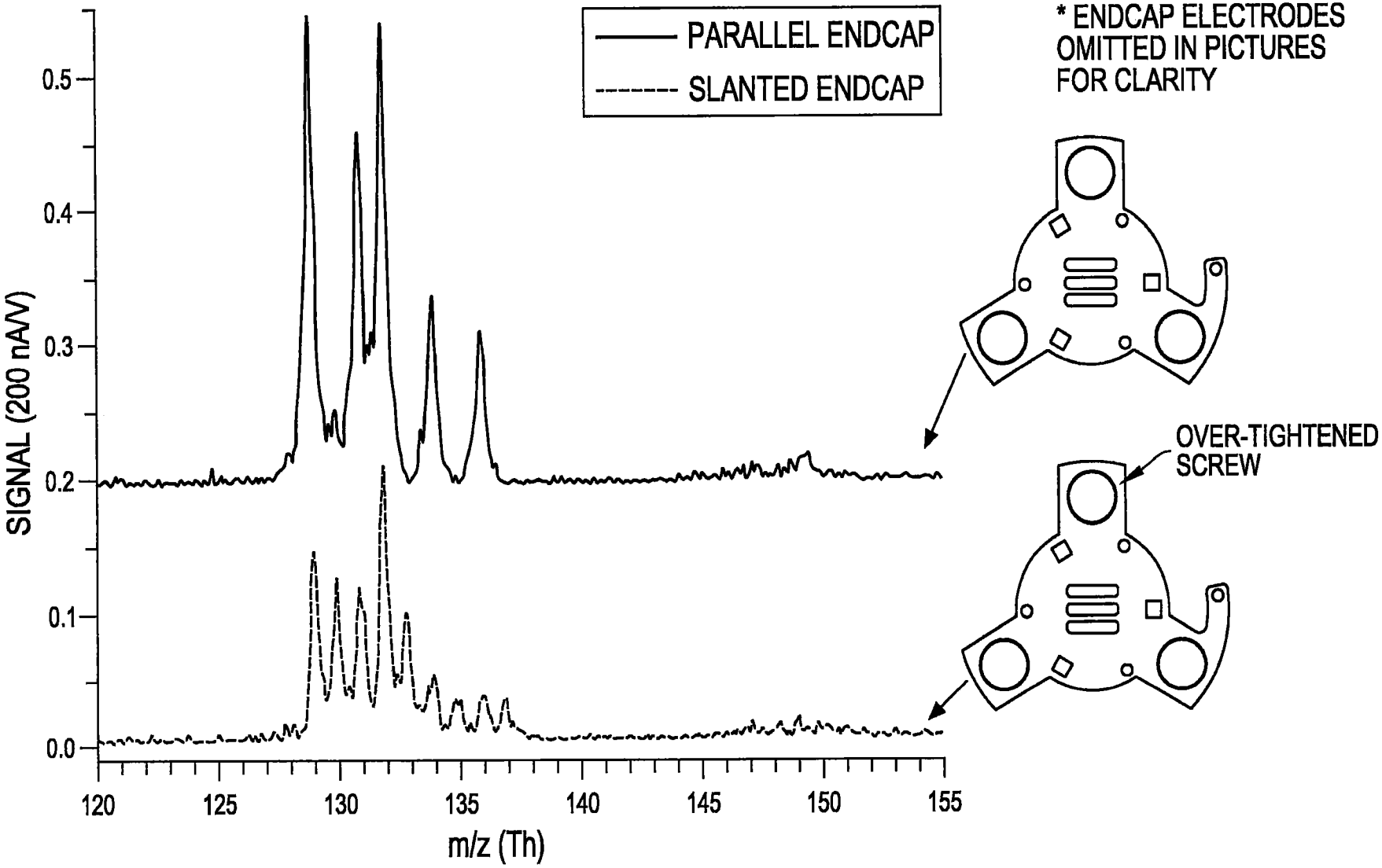
FIG. 15 illustrates experimental results of a mass spectrometry experiment using an array of linear traps.

To test for the minimum time it takes for the ions to fill the entire trapping volume, the same experimental setup was used and the time between the start of ionization and the first Xe peak ejected was shortened as much as possible. Ions were still ejected and observed at the detector at times as low as 1.5 ms, which is the experimental limit of the setup. Thus one may conclude that an ion can be formed and travel the entire length of this serpentine trap at least as fast as 1.5 ms. Referring to FIG. 15, an array of three SLITs identical to the 5 mm single SLIT described above were machined into one middle electrode, separated by 0.50 mm. The experiment shown illustrates that a varying $z_o$ across the three traps leads to ion ejection at different points in the mass ramp. A trap (top inset) was assembled using this middle electrode with every precaution taken to assure the most parallel endcaps. The resulting spectrum of $3.0\times10^{-5}$ torr Xe in 30 mtorr He is shown in the top plot. The chamber was then opened and with no other modifications the top SLIT alignment screw pictured (bottom inset) was over-torqued to produce a slant in the two endcaps relative to the middle electrode leading to a different value of $z_o$ in each of the traps. As theory predicts, during mass spectroscopy operation, the ions eject at different points in the RF ramp causing the total spectrum to be composed of three individual spectra overlaid upon one another. This experiment also illustrates that this overtorqueing technique causes sufficient variation in the z dimension to distinctly affect mass spectra.

Figure 16:
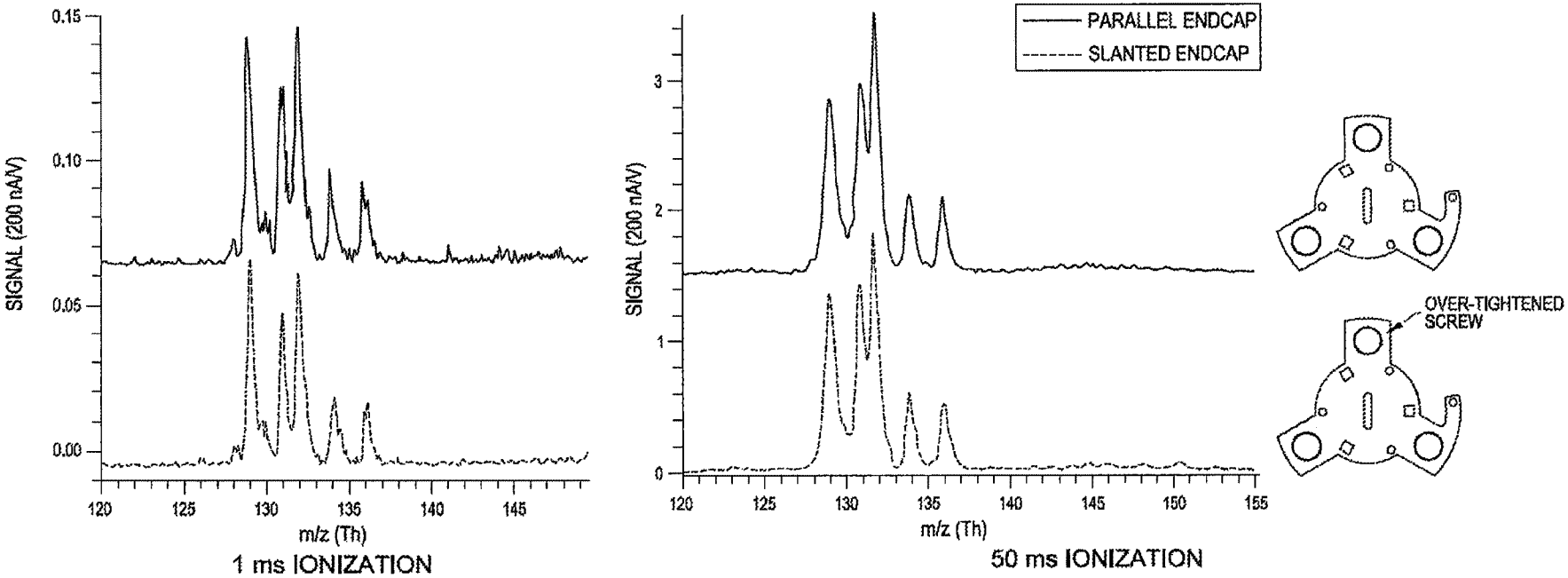
FIG. 16 illustrates experimental results of a mass spectrometry experiment using a singe linear trap.

Referring to FIG. 16, an additional experiment was performed to show effects of varying the $z_0$ dimension along a single trap. A standard 5 mm SLIT of the type described above was assembled and tested in the same manner as the 3 SLIT array on the previous slide with the exception of the single SLIT being turned 90° so that the $z_o$ variation is along its $y_o$ dimension. In this case, the spectra obtained for $3.0\times10^{-5}$ torr Xe in 30 mtorr He were identical whether or not the endcaps were parallel or slanted. This holds true for both moderate amounts of trapped ions (1 ms ionization) and large amounts of trapped ions (50 ms ionization).

Figure 17:
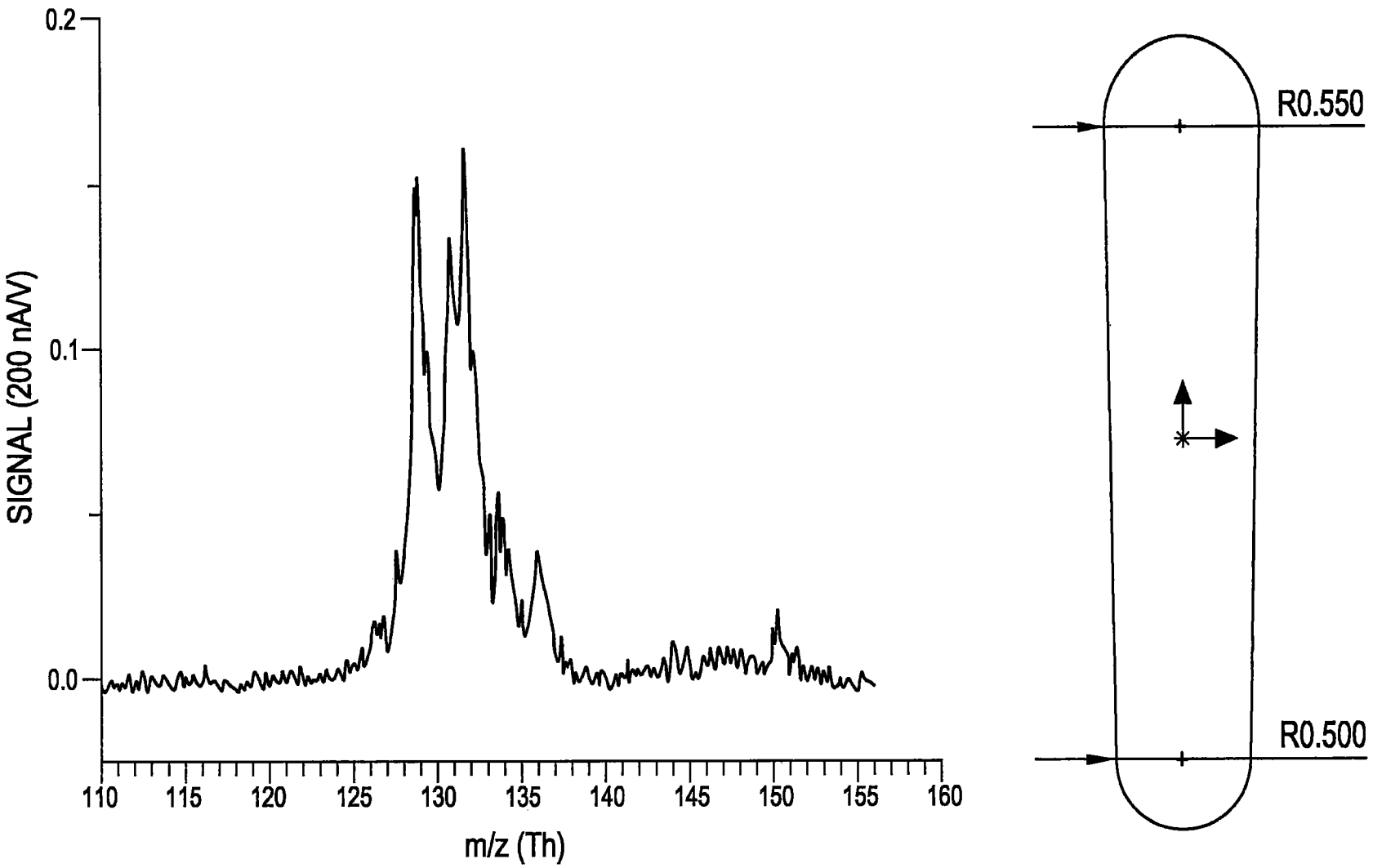
FIG. 17 illustrates experimental results of a mass spectrometry experiment using a tapered linear trap.
Figure 18C:
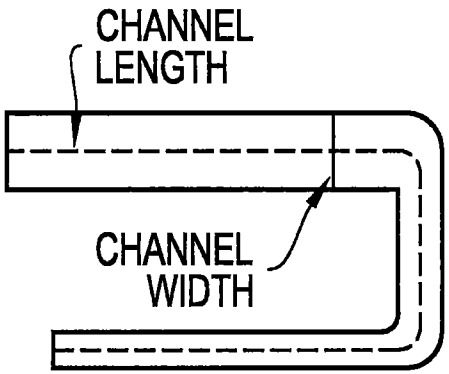
Figure 18B:
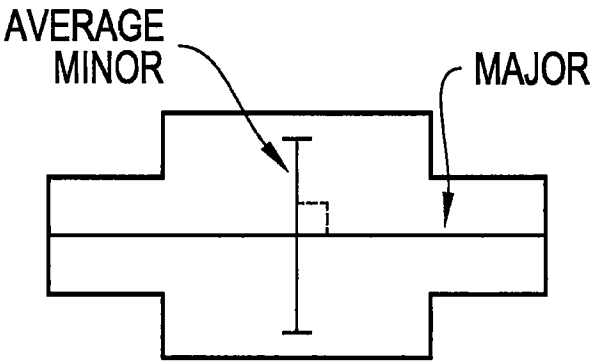
Figure 18A:
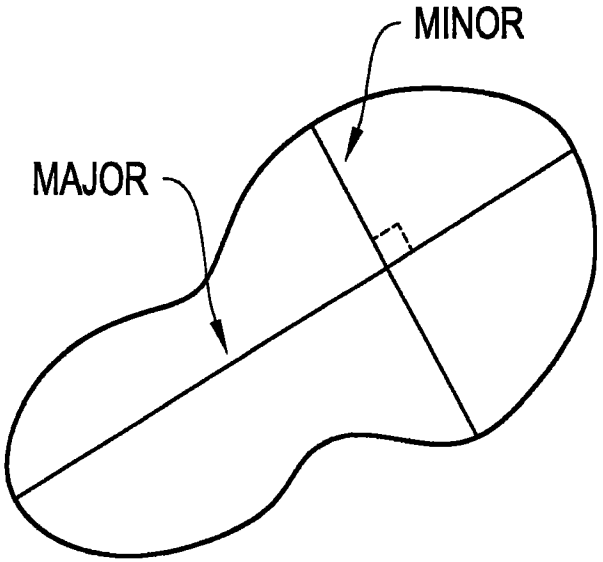

Referring to FIG. 17, a single aperture SLIT was fabricated in which the $x_0$ dimension varied by 10% across the entire $y_o$ dimension making it a complementary experiment to the one described in FIG. 16. Again, a basic mass spectrometry experiment was carried out, analyzing $3.0\times10^{-5}$ torr Xe in 30 mtorr He. The resulting spectrum is shown. While this spectrum is not as well resolved as the previous spectra shown, theory would predict single peak widths of greater than 5 Th, leading to a completely unresolved spectrum. This experiment combined with the results shown in FIG. 16 experiment show that the SLIT geometry is far less affected by poor mechanical tolerances than might be initially expected.

The tolerance of the SLIT performance to variations in both the $x_o$ and $z_o$ dimensions is believed in some configurations to be attributed to spatially specific ion ejection, i.e. all the ions being ejected over a narrow range of the $y_o$ dimension. While the $x_o$ and $z_o$ dimensions can be seen to change significantly over the entire $y_o$ range in the experiments outlined in FIG. 16 and FIG. 17, this variation is negligible over the range of $y_o$ in which the ions are actually ejected. This spatially specific ejection was further studied with the setup shown in FIG. 16 by placing copper shim electrodes behind one half of the trap, sufficiently blocking all ion ejection from that section. This experiment was repeated for the second half of the trap and it was determined that the entire ion signal observed in the full trap was the result of ejection from only one half. It is believed that in some configurations the dimensions of the trap can be tailored towards ion ejection from any desired point, and the resolving power of the device is determined by the geometry of the trap in the region of ejection and relatively insensitive to the geometry of the regions where ions are not being ejected. Moreover, while such structures become less sensitive to overall trapping electrode structure alignment tolerance, they still provide the charge capacity of the overall dimensions of the SLIT structure.

To review, a high capacity ion trap has been successfully developed by stretching a CIT in the horizontal dimension. This trap, with critical dimensions of $z_O$=0.650 μm, $x_O$=500 μm, and $y_O$=5.00 mm has been characterized and compared with a CIT of similar size operated under similar conditions. The signal was seen to increase by an order of magnitude while maintaining the same resolution as the CIT. Trapping capacity was seen to increase linearly with extension in the y dimension.

Operation of the SLIT at increased buffer gas pressures was successfully carried out using both helium and nitrogen at buffer gas pressures up to 1 torr. Both xenon and mesitylene were analyzed using a high-pressure electron multiplier in a differentially pumped vacuum chamber and a Faraday cup in an isobaric chamber, respectively.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

A computer employed to implement at least a portion of the functionality described herein may comprise a memory, one or more processing units (also referred to herein simply as "processors"), one or more communication interfaces, one or more display units, and one or more user input devices. The memory may comprise any computer-readable media, and may store computer instructions (also referred to herein as "processor-executable instructions") for implementing the various functionalities described herein. The processing unit(s) may be used to execute the instructions. The communication interface(s) may be coupled to a wired or wireless network, bus, or other communication means and may therefore allow the computer to transmit communications to and/or receive communications from other devices. The display unit(s) may be provided, for example, to allow a user to view various information in connection with execution of the instructions. The user input device(s) may be provided, for example, to allow the user to make manual adjustments, make selections, enter data or various other information, and/or interact in any of a variety of manners with the processor during execution of the instructions.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of and" consisting essentially of shall be closed or semi-closed transitional phrases, respectively, as set forth in the United States Patent Office Manual of Patent Examining Procedures, Section 2111.03

What is claimed is:

1. A method of measuring mass spectrometry information for a sample, the method comprising:

capturing ions generated from the sample in an ion trap, wherein the ion trap comprises a central electrode extending in a plane orthogonal to a longitudinal axis of the central electrode, and wherein the central electrode comprises a trapping region defined by one or more apertures extending through the central electrode along the longitudinal axis;

selectively ejecting at least some of the captured ions from only a first portion of the trapping region, wherein the first portion corresponds to a first subset of the trapping region; and detecting the ejected ions to obtain mass spectral information about the sample, wherein selectively ejecting at least some of the captured ions comprises using a spatial mask to maintain at least some of the captured ions within a portion of the trapping region that does not correspond to the first portion of the trapping region.

2. The method of claim 1, further comprising generating the ions from the sample in an ion source.

3. The method of claim 2, wherein generating the ions comprises using an electrospray ionization source to generate the ions.

4. The method of claim 1, wherein capturing the ions comprises admitting the ions generated from the sample into a second portion of the trapping region that does not comprise the first portion of the trapping region.

5. The method of claim 1, wherein capturing the ions comprises admitting the ions generated from the sample into a second portion of the trapping region that at least partially comprises the first portion of the trapping region.

6. The method of claim 1, wherein capturing the ions comprises admitting the ions generated from the sample into the entire trapping region.

7. The method of claim 1, wherein:

the trapping region comprises multiple apertures;

the first subset of the trapping region comprises a first group of the multiple apertures;

capturing the ions comprises admitting the ions generated from the sample into a second subset of the trapping region, the second subset of the trapping region comprising a second group of the multiple apertures; and at least some members of the second group of the multiple apertures are different from members of the first group of the multiple apertures.

8. The method of claim 7, wherein each of the members of the first group of the multiple apertures is a member of the second group of the multiple apertures.

9. The method of claim 1, further comprising activating a subset of a plurality of detectors to detect the ejected ions.

10. The method of claim 1, further comprising, after ejecting ions from the first portion of the trapping region:

selectively ejecting at least some of the captured ions from a second portion of the trapping region, wherein the second portion corresponds to a second subset of the trapping region that is different from the first subset of the trapping region; and detecting the ions ejected from the second portion of the trapping region to obtain mass spectral information about the sample.

11. The method of claim 10, wherein:

the trapping region comprises multiple apertures;

selectively ejecting captured ions from the first portion of the trapping region comprises ejecting captured ions from only a first group of the multiple apertures; and selectively ejecting captured ions from the second portion of the trapping region comprises ejecting captured ions from only a second group of the multiple apertures that is different from the first group of the multiple apertures.

12. The method of claim 11, wherein no members of the first group of the multiple apertures are common to the second group of the multiple apertures.

13. The method of claim 11, wherein capturing the ions comprises admitting the ions generated from the sample into a third portion of the trapping region, wherein the third portion corresponds to a third subset of the trapping region comprising a third group of the multiple apertures, and wherein at least some members of the third group of the multiple apertures are different from members of the first and second groups of the multiple apertures.

14. The method of claim 13, each of the members of the first and second groups of the multiple apertures is also a member of the third group of the multiple apertures.

15. The method of claim 11, further comprising, prior to selectively ejecting captured ions from the trapping region:

selectively trapping captured ions corresponding to a first range of ion masses in the first group of the multiple apertures; and selectively trapping captured ions corresponding to a second range of ion masses different from the first range of ion masses in the second group of the multiple apertures.

16. The method of claim 11, further comprising:

activating a first subset of a plurality of detectors to detect the ejected ions from the first portion of the trapping region; and activating a second subset of the plurality of detectors that is different from the first subset of the plurality of detectors to detect the ejected ions from the second portion of the trapping region.

17. A method of measuring mass spectrometry information for a sample, the method comprising:

generating ions from a sample in an ion source;

capturing the generated ions in an ion trap comprising multiple apertures in an electrode of the ion trap, each of the multiple apertures extending laterally in a plane orthogonal to a longitudinal axis of the ion trap, and longitudinally along the axis;

using a spatial mask to selectively eject captured ions from only a first subset of the multiple apertures and detecting the ejected ions to determine mass spectral information for the captured ions from the first subset of the multiple apertures; and selectively ejecting captured ions from only a second subset of the multiple apertures and detecting the ejected ions to determine mass spectral information for the captured ions from the second subset of the multiple apertures, wherein members of the first and second subsets of the multiple apertures are different.

18. The method of claim 17, wherein the captured ions in the first subset of the multiple apertures differ from the captured ions in the second subset of the multiple apertures according to at least one property of the ions.

19. The method of claim 17, further comprising using the spatial mask to selectively eject the captured ions from only the second subset of the multiple apertures.

20. The method of claim 17, wherein the spatial mask is a first spatial mask, the method further comprising using a second spatial mask to selectively eject the captured ions from only the second subset of the multiple apertures.

21. The method of claim 17, wherein the multiple apertures comprise a third subset, and wherein at least some of the generated ions are captured in the third subset of the multiple apertures.

22. The method of claim 21, wherein at least some members of the third subset of the multiple apertures are different from members of the first and second subsets of the multiple apertures.

23. The method of claim 18, wherein the at least one property of the ions is a mass of the ions.

24. The method of claim 23, wherein the captured ions in the first subset of the multiple apertures correspond to a first range of ion masses, and wherein the captured ions in the second subset of the multiple apertures correspond to a second range of ion masses different from the first range of ion masses.

25. A method of measuring mass spectrometry information for a sample, the method comprising:

capturing ions generated from the sample in a trapping region of a central electrode of an ion trap, wherein the trapping region extends through the central electrode;

using a spatial mask to selectively eject some of the captured ions from a first portion of the trapping region and maintain some of the captured ions in a second portion of the trapping region; and detecting the ejected ions to obtain mass spectral information about the sample.

26. The method of claim 25, wherein the trapping region comprises multiple apertures that extend through the central electrode, and wherein each of the first and second portions of the trapping region comprises at least one of the multiple apertures.

27. The method of claim 26, wherein each of the first and second portions of the trapping region comprises multiple apertures.

28. The method of claim 26, wherein ions captured in the first portion of the trapping region correspond to a first range of ion masses, and wherein ions captured in the second portion of the trapping region correspond to a second range of ion masses different from the first range of ion masses.

29. The method of claim 25, wherein the spatial mask is a first spatial mask, the method further comprising using a second spatial mask to selectively eject some of the captured ions from the second portion of the trapping region and maintain some of the captured ions in a third portion of the trapping region.

30. The method of claim 29, further comprising activating a first subset of a plurality of detectors to detect the ions selectively ejected from the first portion of the trapping region, and activating a second subset of the plurality of detectors to detect the ions selectively ejected from the second portion of the trapping region.

31. The method of claim 25, wherein capturing the ions comprises admitting the ions into the entire trapping region.

* * * * *